US010815051B2

(12) United States Patent
Scudder

(10) Patent No.: US 10,815,051 B2
(45) Date of Patent: Oct. 27, 2020

(54) CONTAINER FOR TRANSPORT OF BULK LIQUIDS USING DRY TRAILERS

(71) Applicant: Intermodal Sciences, LLC, New York, NY (US)

(72) Inventor: Erik D. Scudder, New York, NY (US)

(73) Assignee: INTERMODAL SCIENCES, LLC, New York, NY (US)

( * ) Notice: Subject to any disclaimer, the term of this patent is extended or adjusted under 35 U.S.C. 154(b) by 686 days.

(21) Appl. No.: 15/172,439

(22) Filed: Jun. 3, 2016

(65) Prior Publication Data

US 2016/0355332 A1 Dec. 8, 2016

Related U.S. Application Data

(60) Provisional application No. 62/171,624, filed on Jun. 5, 2015.

(51) Int. Cl.
*B65D 88/74* (2006.01)
*B65D 90/52* (2006.01)
(Continued)

(52) U.S. Cl.
CPC ..... *B65D 90/52* (2013.01); *B65D 88/54* (2013.01); *B65D 88/744* (2013.01);
(Continued)

(58) Field of Classification Search
CPC ..... B65D 90/52; B65D 88/54; B65D 88/744; B65D 88/745; B65D 90/00; B65D 90/046
(Continued)

(56) References Cited

U.S. PATENT DOCUMENTS 2,696,235 A 12/1954 Toffolon
3,214,221 A 10/1965 Finnegan
(Continued)

FOREIGN PATENT DOCUMENTS

CN 2711057 Y 7/2005
CN 103502111 A 1/2014
(Continued)

OTHER PUBLICATIONS

International Search Report and Written Opinion for International Patent Application No. PCT/US2012/024112, dated May 23, 2012.
(Continued)

*Primary Examiner* — J. Gregory Pickett
*Assistant Examiner* — Niki M Eloshway
(74) *Attorney, Agent, or Firm* — Cooley LLP

(57) ABSTRACT

A system includes a rigid container configured to receive a dry cargo and a flexible container configured to receive a bulk liquid. The flexible container is configured to be disposed within the rigid container when the flexible container contains the bulk liquid. The flexible container includes a set of container portions and a set of restriction portions. Each container portion has a first cross-sectional area and each restriction portion defines a second cross-sectional area less than the first cross-sectional area. Each restriction portion is disposed between a pair of adjacent container portions and is configured to restrict a flow of the bulk liquid therebetween. The restricting of the flow of the bulk liquid between the container portions is configured to limit load shifting associated with the flexible container when disposed in the rigid container.

19 Claims, 8 Drawing Sheets

(51) Int. Cl.
*B65D 88/54* (2006.01)
*B65D 90/04* (2006.01)
*B65D 90/00* (2006.01)
*B65D 88/12* (2006.01)

(52) U.S. Cl.
CPC ..... *B65D 88/745* (2013.01); *B65D 90/00* (2013.01); *B65D 90/046* (2013.01)

(58) Field of Classification Search
USPC ..... 220/1.6, 592.28, 563
See application file for complete search history.

(56) References Cited

U.S. PATENT DOCUMENTS 3,306,675 A 2/1967 Fritz
3,696,952 A 10/1972 Bodenheimer
RE27,872 E 1/1974 Esty
3,868,042 A 2/1975 Bodenheimer
3,917,354 A 11/1975 Adams, Jr. et al.
3,951,284 A 4/1976 Fell et al.
4,054,161 A 10/1977 Alack
4,101,292 A 7/1978 Hogan
4,232,803 A 11/1980 Muller et al.
4,461,402 A 7/1984 Fell et al.
4,671,733 A 6/1987 Krein
4,674,127 A 6/1987 Yamada et al.
4,756,447 A * 7/1988 Gerhard ..... B65D 88/744 220/565
4,765,779 A 8/1988 Organ
4,872,493 A 10/1989 Everman
4,882,912 A * 11/1989 Fossey ..... B65D 88/128 62/297
4,911,317 A 3/1990 Schloesser et al.
4,941,589 A 7/1990 Chen
4,966,310 A 10/1990 Hawkins
5,040,693 A 8/1991 Podd, Sr. et al.
5,195,197 A 3/1993 Gutierrez et al.
5,199,826 A 4/1993 Lawrence
5,244,332 A 9/1993 Krein et al.
5,332,095 A 7/1994 Wu
5,353,728 A * 10/1994 Strange ..... B63B 25/082 114/74 R
5,547,331 A 8/1996 Podd et al.
5,553,639 A 9/1996 Erickson
5,564,599 A 10/1996 Barber et al.
5,576,037 A 11/1996 Moore et al.
5,938,338 A 8/1999 McDonough
5,983,957 A 11/1999 Erickson
6,095,367 A * 8/2000 Blair ..... B60K 15/03006 220/23.2
6,109,786 A 8/2000 Hafer et al.
6,132,088 A 10/2000 Suzuki
6,186,713 B1 * 2/2001 Bonerb ..... B60P 3/426 141/314
6,202,849 B1 3/2001 Graham
6,286,700 B1 9/2001 Davidson
6,447,826 B1 9/2002 Matthews
6,454,496 B1 9/2002 Mills et al.
6,467,955 B1 10/2002 Kim
6,477,970 B1 11/2002 Ayorinde
6,478,517 B1 11/2002 Nelson et al.
6,550,645 B2 4/2003 Nelson et al.
6,575,629 B1 6/2003 Perkins
6,860,218 B2 * 3/2005 Eagles ..... B63B 35/285 114/256
7,086,429 B2 8/2006 Moizumi
7,389,627 B2 6/2008 Miles
7,434,520 B2 10/2008 Zupancich et al.
7,588,160 B2 9/2009 Chen
7,717,296 B1 * 5/2010 Guthrie ..... B65D 88/22 220/563
8,066,135 B2 * 11/2011 Albers ..... B60P 3/426 220/1.6
8,141,328 B2 3/2012 Villers et al.
8,287,791 B2 10/2012 Stackpole
8,313,268 B2 11/2012 Kords et al.
8,418,731 B2 4/2013 Kords et al.
8,662,341 B2 3/2014 Kohen
8,690,021 B2 4/2014 Asraf
8,926,178 B2 * 1/2015 Kohen ..... B65D 90/046 220/1.6
9,033,178 B2 * 5/2015 White ..... F17C 5/02 220/560.04
9,090,392 B2 7/2015 Loeschen et al.
9,394,105 B2 7/2016 Li
9,567,157 B2 2/2017 Scudder et al.
2002/0164093 A1 11/2002 Burkhardt
2003/0197009 A1 10/2003 Mino
2006/0175324 A1 8/2006 Podd
2006/0186117 A1 8/2006 Podd
2006/0251343 A1 11/2006 True
2007/0021774 A1 1/2007 Hogendijk
2007/0022718 A1 2/2007 McLaughlin et al.
2007/0023438 A1 2/2007 Kenneth, Jr.
2007/0084147 A1 4/2007 Korten et al.
2007/0102428 A1 5/2007 Eamcharoenying
2007/0201774 A1 8/2007 Plunkett et al.
2007/0215505 A1 9/2007 Walker
2008/0179330 A1 7/2008 Brooks et al.
2008/0190918 A1 8/2008 Bellmore
2008/0307755 A1 12/2008 Stelliferi et al.
2009/0065380 A1 3/2009 Yucel
2009/0087609 A1 4/2009 Masui et al.
2009/0234317 A1 9/2009 Navarro
2009/0238498 A1 9/2009 Lin
2009/0277566 A1 11/2009 Lawrence et al.
2009/0314790 A1 * 12/2009 Eenkhoorn ..... B60P 3/2235 220/723
2010/0122981 A1 5/2010 Sims
2010/0147728 A1 6/2010 Guiles et al.
2010/0163557 A1 * 7/2010 Bartlett ..... B65D 90/046 220/62.21
2010/0192998 A1 8/2010 Villers et al.
2010/0270297 A1 * 10/2010 Villers ..... A01F 25/14 220/1.6
2011/0027018 A1 2/2011 Baker et al.
2011/0083768 A1 4/2011 Sims et al.
2011/0198368 A1 8/2011 Asraf
2011/0240652 A1 * 10/2011 Kohen ..... B65D 88/16 220/501
2011/0272413 A1 * 11/2011 Yaremenko ..... B65D 88/1606 220/563
2012/0279959 A1 * 11/2012 Clive-Smith ..... B65D 90/048 220/9.4
2013/0036711 A1 2/2013 Scudder et al.
2013/0089925 A1 * 4/2013 Damren ..... C12M 41/24 435/303.3
2013/0098785 A1 4/2013 Steffens
2013/0101237 A1 4/2013 Kohen
2013/0239523 A1 9/2013 Scudder et al.
2015/0076166 A1 * 3/2015 Townsend ..... B65D 25/14 220/694
2015/0128880 A1 * 5/2015 Hoffman ..... F28D 1/0213 122/15.1
2016/0130078 A1 * 5/2016 Galvin ..... B65D 90/046 141/1

FOREIGN PATENT DOCUMENTS

EP 0635439 A1 1/1995
EP 0538563 B1 4/1997
EP 0771738 A1 5/1997
EP 1252011 B1 4/2005
GB 2153798 A 8/1985
GB 2461934 A 1/2010
WO WO 2006/046038 A2 5/2006
WO WO 2007/112383 A1 10/2007
WO WO 2010/046790 A1 4/2010
WO WO 2012/016077 A1 2/2012
WO WO 2012/109217 A1 8/2012

(56) References Cited

FOREIGN PATENT DOCUMENTS

| | | | |
|---|---|---|---|
| WO | WO 2013/169869 | A1 | 11/2013 |
| WO | WO 2016/196938 | A1 | 12/2016 |

OTHER PUBLICATIONS

International Search Report and Written Opinion for International Patent Application No. PCT/US2013/040091, dated Sep. 5, 2013.
International Search Report and Written Opinion for International Patent Application No. PCT/US2016/035725, dated Nov. 7, 2016.
Search and Exam Report for British Patent Application GB 1202085.5, dated Apr. 25, 2012.
Chinese Office Action for the application 201280013940.3, dated Sep. 17, 2014.
Office Action for U.S. Appl. No. 13/367,911, dated Feb. 24, 2015.
Chinese Second Office Action for the application 201280013940.3, dated Mar. 6, 2015.
Office Action for U.S. Appl. No. 13/367,911, dated Sep. 10, 2015.
Examination Report for Australian Application AU 2012214554, dated Nov. 4, 2015.
Chinese Office Action for the application 201380036572.9, dated Jan. 22, 2016.
Office Action for U.S. Appl. No. 13/889,654, dated Feb. 11, 2016.
Search and Exam Report for British Patent Application GB 1600664.5, dated Feb. 23, 2016.
Examination Report for British Patent Application GB 1202085.5, dated Mar. 9, 2016.
Examination Report for British Patent Application GB 1600663.7, dated Mar. 9, 2016.
Office Action for U.S. Appl. No. 13/367,911, dated Apr. 4, 2016.
Examination Report for Australian Application AU 2012214554, dated Jun. 6, 2016.
Examination Report for Australian Application AU 2013259629, dated Jun. 8, 2016.
Office Action for U.S. Appl. No. 13/889,654, dated Oct. 20, 2016.
LiquaTrans, T-Flex // Trailer Flexitank, [retrieved from the Internet] [retrieved on Jan. 26, 2015 at URL: http://www.liquatrans.com/en/liquid_bulk/detay/t-flex--trailer-flexitank/3/.

* cited by examiner

CONTAINER FOR TRANSPORT OF BULK LIQUIDS USING DRY TRAILERS

CROSS-REFERENCE TO RELATED APPLICATIONS

This application claims priority to and the benefit of U.S. Provisional Patent Application Ser. No. 62/171,624 entitled, "Containers for Transport of Bulk Liquids Using Dry Trailers," filed Jun. 5, 2015, the disclosure of which is incorporated herein by reference in its entirety.

BACKGROUND

It is currently estimated that the United States domestic trucking industry operates 15.5 million trucks. These trucks travel in excess of 44 billion miles every year and deliver 70% of all freights to their final destinations. The value of cargoes moved every year on United States roads tops $675 billion. Additionally, each year Canadian cargo business totals $295 billion and Mexican cargo business totals $195 billion. The transportation by road of bulk liquid products is included in these statistics. Approximately 2 million of these liquid tank trucks are tractor trailer combinations, many of which run "dead head" looking for back hauls.

Transportation of bulk liquids can present certain challenges not found in hauling dry or solid materials. For example, the transportation of bulk liquids and semi-liquids can result in waves traveling through the container. In the case of a 40 foot or 53 foot bag, amongst others, such waves can generate substantial dynamic forces based on the free-surface effect of the liquids. For example, a truck traveling at 15 mph coming to an abrupt stop may generate waves producing high localized pressures.

Accordingly, bulk liquid and semi-liquids products are generally moved across North American and Global roads in tanker trucks. These products include highly hazardous products such as gasoline or heavy oils (e.g., heavy crude oil), non-hazardous petrochemicals such as baby oil, and food products such as olive oil, as well as many others. Many trucks are specialized for particular product groups and dedicated to certain traffic lanes. This is especially the case for food grade, chemical grade, and/or pharmaceutical grade products where in many instances trucks move loaded in one direction and return empty in the other, the customer having to pay for the complete round trip (an issue also faced in other modes of shipping such as transport via rail or the like). Tanker trucks are regularly cleaned, in most cases between each load, and where food grade products are concerned, a variety of governmental and industry regulations (e.g., Food and Drug Administration (FDA), kosher certification bodies, Halal standards, etc.) programs can be implicated, which can increase the cost and complexity of cleaning.

Other known systems for transporting bulk liquids include flexible bags in 20 foot containers (often referred to as "flexi-tanks"). The dynamic pressure that develops in such a bag, however, can apply forces that may be sufficient to break the bag and/or damage the shipping container or box van (e.g., potentially bulging the side walls of the container). Moreover, the dynamic forces can also cause the vehicle pulling the trailer, to roll forward at mandatory stops such as traffic lights or stop signs. Some known bulk liquid containers have employed various types of wave restrictors to address this problem. Frequently, the wave restrictors chosen are too expensive (e.g., iron bars used as a tamping mechanism) either from manufacturing cost or return logistic costs of materials. Moreover, some known wave restrictors include internal baffles and/or other similar structures that can introduce one or more points of manufacturing and/or material failure. An alternative approach is to place multiple small bags in a truck trailer. The use of multiple small bags is more expensive and is inefficient in both the loading and unloading process. For example, additional work may be involved including hooking up and disconnecting load and unload hoses multiple times per shipment. There may also be safety issues related to walking on loaded or discharged tank equipment and increased possibility of excess residual product left inside the individual tanks, which can increase a percentage of lost or unused product.

Moreover, increased policing of the driving laws, especially hours of the drivers daily service, has placed rigorous restrictions on drivers and trucking companies. This has resulted in a national shortage of drivers, which has affected the tanker truck industry in particular. In recent years, it has become increasingly difficult for shippers to obtain tanker trucks especially for on demand short notice hauls. Most major users of tanker trucks are now entering into long term contracts with carriers to guarantee their supply of vehicles. Even with these contracts in place, the shippers find difficulties in securing additional vehicles at short notice in the event of a spike in their business.

The storage and shipment of highly viscous liquids also presents challenges. For example, heavy crude oil and/or extra heavy crude oil is a dense, highly viscous, and corrosive petroleum product (e.g., bulk liquid) that has a low flowability. Specifically, extra heavy crude oil, bitumen, and/or other forms of heavy crude oil (referred to herein as "heavy oil") is a sludge-like bulk liquid that is typically heated to increase its flowability to allow for loading into large storage reservoirs and/or shipping tanks. For example, in some instances, the heavy oil can be removed from the ground at a relatively hot temperature, stored in a heated storage reservoir, and then delivered to one or more shipping containers, rail cars (trains), or tanks. Maintaining the heavy oil at an elevated temperature, however, uses energy and the heated heavy oil can pose safety risks to people and/or equipment. In addition, the availability of shipping containers can, in some instances, limit production of heavy oil. For example, in some instances, a train including shipping containers suitable for transporting heavy oil may arrive at a production site (e.g., oil drilling site or other oil production site) on a relatively fixed schedule that results in a bottle neck in production. That is to say, heavy oil can be extracted from the ground at a higher rate than a rate at which it can be shipped. As a result, the heavy oil is at least temporarily in storage reservoirs that can, in some instances, reach a maximum fill level before the next train arrives at the production site.

In other instances, the heavy oil is diluted to increase its flowability (e.g., up to 50% dilution or more). The diluents (e.g., Pentane, $C_5$ hydrocarbons, and/or the like), however, are often highly volatile and result in a diluted substance that is very flammable and combustible. In addition, the diluted substance (e.g., diluted heavy oil) is separated at refineries and/or by end users and the waste diluents are shipped back to the point of production (via trucks and/or rail cars). Thus, using diluents to increase the flowability of heavy oil is inefficient and results in the transport of dangerous substances.

Whether diluted or non-diluted, the heavy oil (e.g., bitumen) is susceptible to the same or more load shifting (e.g., wave creation) as other bulk liquids. In addition, restrictions have been placed on the shipping over sea (e.g., international transport via tanker ships or the like) of heavy oil resulting from heavy oil having a density greater than water (i.e., because heavy oil does not float).

Modes of shipping such as via train and/or tanker ship (transoceanic shipping) face similar challenges to those described above with reference to shipping via trucks. Thus, a need exists for improved methods and devices for safe and efficient storage of bulk liquids including, for example, heavy crude oil or the like as well as for safe and efficient shipping of such bulk liquids via any suitable shipping mode.

SUMMARY

Apparatus for moving bulk liquids while limiting dynamic forces (e.g., due to liquid movement and shifting) on the apparatus or apparatus carrier are described herein. In some embodiments, a system includes a rigid container configured to receive a dry cargo and a flexible container configured to receive a bulk liquid. The flexible container is configured to be disposed within the rigid container when the flexible container contains the bulk liquid. The flexible container includes a set of container portions and a set of restriction portions. Each container portion from the set of container portions has a first cross-sectional area and each restriction portion from the set of restriction portions defines a second cross-sectional area less than the first cross-sectional area. Each restriction portion from the set of restriction portions is disposed between a pair of adjacent container portions and is configured to restrict a flow of the bulk liquid therebetween. The restricting of the flow of the bulk liquid between the container portions is configured to limit load shifting associated with the flexible container when disposed in the rigid container.

DETAILED DESCRIPTION

Figure 1:
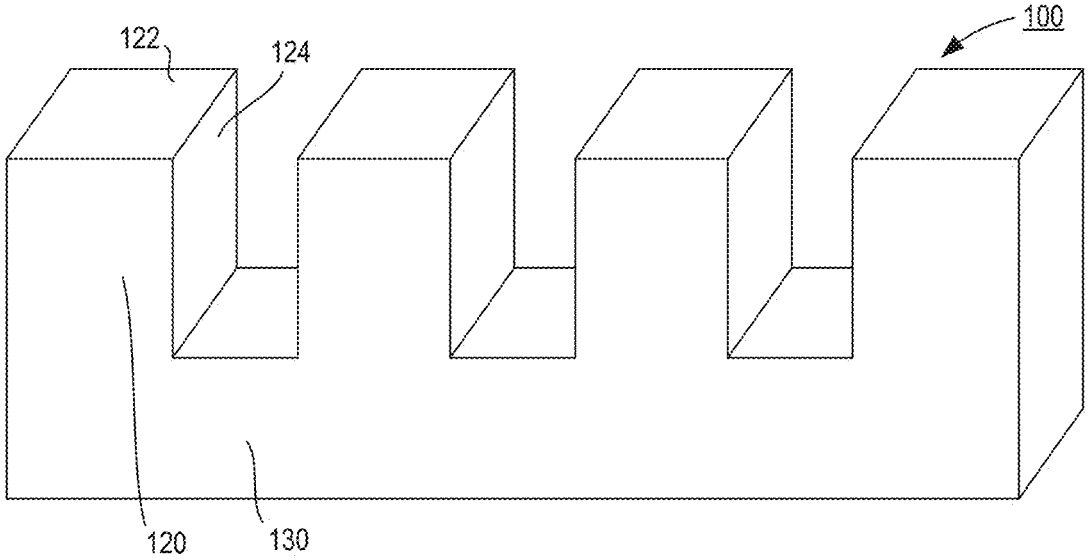
FIG. 1 is a perspective view illustration of a flexible container according to an embodiment.

Some embodiments described herein relate to tanks and/or containers (also referred to herein as flexible container) configured to store and/or transport bulk liquids. In some embodiments, a system includes a rigid container configured to receive a dry cargo and a flexible container configured to receive a bulk liquid. The flexible container is configured to be disposed within the rigid container when the flexible container contains the bulk liquid. The flexible container includes a set of container portions and a set of restriction portions. Each container portion from the set of container portions has a first cross-sectional area and each restriction portion from the set of restriction portions defines a second cross-sectional area less than the first cross-sectional area. Each restriction portion from the set of restriction portions is disposed between a pair of adjacent container portions and is configured to restrict a flow of the bulk liquid therebetween. The restricting of the flow of the bulk liquid between the container portions is configured to limit load shifting associated with the flexible container when disposed in the rigid container.

In some embodiments, a system includes a flexible container, a cooling means, and a forming device. The flexible container defines an interior volume configured to receive a volume of heated heavy oil. The cooling means is configured to be in thermal contact with the interior volume of the flexible container to transfer thermal energy away from the heated heavy oil. The forming device is configured to exert a uniform pressure on at least one side of the flexible container. A gas contained in the interior volume is evacuated when the forming device exerts the uniform pressure to transition the flexible container from an expanded configuration to a collapsed configuration, in which the flexible container has a substantially rigid form such that a flow of the heavy oil within the interior volume is limited.

In some embodiments, a method for packaging bulk liquids within a flexible container includes conveying a bulk liquid into an interior volume of a flexible container. The flexible container has a plurality of container portions and a plurality of restriction portions, each restriction portion from the plurality of restriction portions being disposed between a pair of adjacent container portions and configured to restrict a flow of the bulk liquid therebetween. A gas is evacuated from the interior volume of the flexible container. The flexible container is disposed in a rigid shipping container configured to receive a dry cargo. The restricting of the flow of the bulk liquid between the container portions is configured to limit load shifting associated with the flexible container when disposed in the rigid container.

In some embodiments, an apparatus includes a flexible container with at least one restriction portion. The at least one restriction portion divides the flexible container into a series of container portions. The flexible container includes at least one port for loading and unloading liquids from the tank, for venting a gas from the flexible container, and/or for introducing a cooling means and/or inert gas. The restriction portion dampens the forces exerted by the moving liquids, reducing the risk of breakage of the flexible container and the flexible container carrier.

As used in this specification, the singular forms "a," "an" and "the" include plural referents unless the context clearly dictates otherwise. Thus, for example, the term "a member" is intended to mean a single member or a combination of members, "a material" is intended to mean one or more materials, or a combination thereof.

As used herein, the term "flexible" and/or "flexibility" relates to an object's tendency towards deflection, deformation, and/or displacement under an applied force. For example, a material with a greater flexibility is more likely to deflect, deform, and/or be displaced when exposed to a force than a material having a lower flexibility. Similarly stated, a material having a higher degree of flexibility can be characterized as being less rigid than a material having a lower degree of flexibility. Flexibility can be characterized in terms of the amount of force applied to the object and the resulting distance through which a first portion of the object deflects, deforms, and/or displaces with respect to a second portion of the object. In certain situations, this can be depicted graphically as a stress-strain curve. When characterizing the flexibility of an object, the deflected distance may be measured as the deflection of a portion of the object different from the portion of the object to which the force is directly applied. Said another way, in some objects, the point of deflection is distinct from the point where force is applied.

Flexibility is an extensive property of the object being described, and thus is dependent upon the material from which the object is formed and certain physical characteristics of the object (e.g., shape of the object, number of plies of material used to construct the object, and boundary conditions). For example, the flexibility of an object can be increased or decreased by selectively including in the object a material having a desired modulus of elasticity, flexural modulus, and/or hardness. The modulus of elasticity is an intensive property of (i.e., is intrinsic to) the constituent material and describes an object's tendency to elastically (i.e., non-permanently) deform in response to an applied force. A material having a high modulus of elasticity will not deflect as much as a material having a low modulus of elasticity in the presence of an equally applied force. Thus, the flexibility of the object can be increased, for example, by introducing into the object and/or constructing the object of a material having a relatively low modulus of elasticity.

Similarly, the flexural modulus is used to describe the ratio of an applied stress on an object in flexure to the corresponding strain in the outermost portions of the object. The flexural modulus, rather than the modulus of elasticity, is used to characterize certain materials, for example plastics, that do not have material properties that are substantially linear over a range of conditions. An object with a first flexural modulus is more elastic and has a lower strain on the outermost portions of the object than an object with a second flexural modulus greater than the first flexural modulus. Thus, the flexibility of an object can be increased by including in the object a material having a relatively low flexural modulus.

The flexibility of an object constructed from a polymer can be influenced, for example, by the chemical constituents and/or arrangement of the monomers within the polymer. For example, the flexibility of an object can be increased by decreasing a chain length and/or the number of branches within the polymer. The flexibility of an object can also be increased by including plasticizers within the polymer, which produces gaps between the polymer chains.

As used herein, the terms "expandable," "expanded configuration," "collapsible," and/or "collapsed configuration" relate to a flexible container defining a first cross-sectional area (or volume) and a second cross-sectional area (or volume). For example, a flexible container of the types described herein, can define a larger cross-sectional area (or volume) when in an expanded configuration than the cross-sectional area (or volume) of the flexible container in the collapsed configuration. Expandable components described herein can be constructed from any material having any suitable properties. Such material properties can include, for example, a flexible material having a high tensile strength, high tear resistance, high puncture resistance, a suitable level of compliance (e.g., the expandable components ability to expand appreciably beyond its nominal size), and/or a suitable modulus of elasticity (e.g., as described above). Moreover, some flexible containers described herein can configuration (different from the expanded configuration and the collapsed configuration) when not in use (e.g., prior to use and/or while being stored). For example, in some embodiments, a flexible container can be folded and/or rolled.

In some embodiments, for example, an expandable component (e.g., a flexible container) can include at least a portion constructed from a high-compliant material configured to significantly elastically deform when expanded. In other embodiments, an expandable component (e.g., the flexible container) can include at least a portion constructed from a low-compliant material (e.g., a material configured to expand without significant elastic deformation). The compliance of an expandable component defining, for example, an interior volume, is the degree to which a size of the expandable component (in an expanded state) changes as a function of the pressure within the interior volume. For example, in some embodiments, the compliance of a flexible container can be used to characterize the change in the diameter or cross-sectional area of the expanded and/or collapsed flexible container as a function of the pressure within the interior volume defined by the flexible component. In some embodiments, the diameter or cross-sectional area of an expanded component characterized as a low-compliant component can change by zero to ten percent over a range of pressures applied to the interior volume thereof (e.g., either a positive pressure or a vacuum). In other embodiments, the diameter or cross-sectional area of an expanded component characterized as a high-compliant component can change as much as 30 percent, 50 percent, 100 percent or greater.

Because the overall characteristics of a flexible container, including the compliance, can be a function of both the material from which the flexible container is constructed and the structural characteristics of the flexible container, the material from which the flexible container is constructed can be selected in conjunction with the desired structural characteristics of the flexible container. For example, in some embodiments, a flexible container can include a first portion defining a first compliance and/or flexibility and a second portion defining a second compliance and/or flexibility. In such embodiments, it can be desirable that the first portion (e.g., a bottom portion) include a lower compliance and/or greater stiffness than the second portion (e.g., a top portion). Thus, the first portion of the flexible container can be configured to deform less under increased or decreased pressure within an interior volume than the second portion. For example, in some embodiments, a force exerted by a bulk material (e.g., the weight of the bulk material) may be such that substantial deformation of the first portion could result in tearing of the material. In some embodiments, at least a portion of the flexible container can be reinforced with one or more additional layers and/or materials. For example, in some embodiments, at least a portion of the flexible container (e.g., a bottom portion) can include a lattice structure, mesh, wire, and/or hardened layer configured to at least partially retain a desired shape, as described in further detail herein. In other embodiments, a flexible container can include, for example, an inner portion or layer having a higher compliance than an outer portion or layer.

As used herein, the terms "bulk liquid" and/or "bulk material" relates to a cargo that is transported in large quantities in the absence of individual packaging. Bulk liquid, bulk material, and/or bulk cargo can be very dense, viscous, corrosive, volatile, caustic, or abrasive. Bulk material can be a solid or dry material or a liquid material. Examples of dry bulk material can include, for example, bauxite, sand, gravel, copper, limestone, salt, cement, fertilizers, plastic granular, resin powders, coal (e.g., lignite, bituminous, and/or anthracite, etc.), grains, iron (e.g., iron ore, direct reduced iron, pig iron, etc.). Examples of liquid material can include, for example, food grade liquids (e.g., olive oil, milk, etc.), baby oil, gasoline, liquefied natural gas, petroleum, heavy crude oil, and/or the like. Some liquid bulk materials, for example, heavy crude oil can be highly viscous with low flowability, can be corrosive, and can be highly volatile when diluted with common diluents (e.g., flammable and/or capable of spontaneous combustion). As described in further detail herein, bulk materials and bulk liquids in particular can be prone to load (e.g., weight) shifting and/or wave generation during shipping and/or transport, which can result in very high localized pressures applied on a container in which the material is disposed. Thus, some of the flexible containers described herein can be configured to receive and contain a bulk material and/or bulk liquid and can include one or more features or the like configured to limit load shifting and/or wave generation.

Any of the flexible containers described herein can be used in the storage and/or transport of highly viscous bulk liquids such as heavy crude oil and/or extra heavy crude oil. As used herein the term "heavy oil," generally refers to heavy crude oil and/or extra heavy crude oil. Heavy oil is a dense, highly viscous, and corrosive petroleum product (e.g., bulk liquid) that has a low flowability. Heavy oil is a sludge-like liquid petroleum with an American Petroleum Institute gravity (API gravity) of less than 20° and a viscosity and density that is greater than water. Extra heavy oil, for example, has an API gravity of 10° or less and a viscosity of up to 10,000 centipoises (cP) or more. By way of example, Canadian extra heavy crude oil can have a viscosity of 5,000 cP to 10,000 cP, a viscosity similar to that of molasses. In some instances, heavy oil can be a semi-solid or quasi-solid with very low flowability such as, for example, bitumen and/or the like.

In some instances, a flexible container can convert a common rigid storage container or a 53 foot box van into a bulk liquid unit, which will reduce empty back haul miles, increase utilization of commonly used equipment, and fill an unmet need in service. In addition, the flexible containers described herein can allow for the storage and/or transport of heavy and/or highly viscous bulk liquids such as heavy crude oil or the like. In some instances, the flexible containers described herein can be used for the storage and/or transport of diluted heavy oil that can be highly volatile. In other instances, the use of the flexible containers described herein can allow for the storage and/or transport of heavy oil and/or the like without being diluted.

Any of the flexible containers described herein can be disposable and/or recyclable flexible units, constructed from polyethylene and/or other plastic materials that can be placed in standard shipping containers (e.g., rigid shipping containers configured to dry storage), dry van trailers, and/or other suitable intermodal container. For example, a flexible container can be sized for North American use (53 foot), European use (20 meter), and other standard trailer configurations and/or be customized to any sized trailer. The flexible container readily turns this equipment into a bulk liquid carrier, allowing, for example, a shipping vehicle (e.g., tractor trailer, box van, etc.) more opportunities to backhaul, which in turn reduces freight costs.

In some embodiments, the flexible containers carry a wide range of non-hazardous chemical and/or food grade products and can have a size configured to maximize carrying capacity based on the weight of the product to be transported. In other embodiments, the flexible containers can be constructed of any suitable material for containing hazardous materials, can be lined, and/or can be reinforced for compliance with hazardous material handling regulations as necessary. In some instances, the flexible containers can be constructed and/or customized to meet customer requests for their particular products.

In some instances, flexible containers can be pre-positioned at strategic locations, such as drilling sites, refineries, ports, and/or railway depots. For example, standard sized flexible containers (e.g., flexible containers configured to fit within a standard sized trailer) can have a volume ranging from 2,000 to 6,000 gallons in single compartment units. In this way, the availability of the flexible container at strategic locations (e.g., in major trade lanes as required by the customer) can be improved such that a customer with a standard trailer will be able to transport bulk liquid product. This can lead to reduced waiting or delays in loading cargo to meet the customer's requirements. Flexible container can also use existing equipment more efficiently, resulting in a "greener" operation. In some instances, multiple flexible containers can be stacked and stored prior to being loaded into a rigid container or the like. As such, the flexible containers filled with a bulk liquid such as, for example, heavy oil can be staged prior to being loaded into a container of a rail car or box van. In some instances, staging the flexible containers in such a manner can obviate the use of large heated storage reservoirs configured to contain heavy oil or the like.

In some embodiments, any of the flexible containers described herein can be manufactured from high grade low density polyethylene and can be made to U.S. Food and Drug Administration (FDA) standards and European Union food directives. Any of the flexible containers described herein can be constructed from one or more layers of polyethylene tubes with an outer cover made from a single layer of woven polypropylene. Due to the length of the flexible container, the height is relatively low which results in a low center of gravity.

Any of the flexible containers described herein can be formed from any suitable material or material combination. For example, in some embodiments, the flexible containers can be formed from polyethylene, ethylene vinyl acetate (EVOH), amorphous polyethylene terephthalate (APET), polypropylene (PP), high-density polyethylene (HDPE), polyvinylchloride (PVC), polystyrene (PS), polyethylmethacrylate (EMA), metallocene polyethylene (plastomer metallocene), low-density polyethylene (LDPE), high-melt strength (LDPE), ultra-low-density linear polyethylene (ULLDPE), linear low-density polyethylene (LLDPE), K-resin, polybutadiene, and/or mixtures, copolymers, and/or any combination thereof. As used herein the term "copolymer" includes not only those polymers having two different monomers reacted to form the polymer, but two or more monomers reacted to form the polymer. In some embodiments, the materials listed above are a film or sheet and used to form at least a portion of a flexible container. In other embodiments, the materials listed above are woven and used to form at least a portion of a flexible container. In still other embodiments, the materials can include a lattice structure and/or can be embedded with and/or coupled to a wire mesh or the like. In some embodiments, the arrangement of the flexible containers and/or the constituent materials can be such that the flexible containers are at least semi-permeable (e.g., gas permeable but liquid impermeable). In other embodiments, the flexible containers and/or the constituent materials can be impermeable (e.g., to solids, liquids, and gases). Furthermore, in some embodiments, a flexible container can be formed of a consumable material that can be recycled, shredded, burned, etc. at a point of use (e.g., a refinery or the like).

The flexible container systems and methods described herein readily convert regular box vans and/or standard dry shipping containers of various sizes into bulk liquid carriers. In some embodiments, the flexible containers can be sized in accordance with the weight of the liquid being transported to achieve maximum payload capacity. In some embodiments, any of the flexible containers described herein can be disposable (e.g., designed for a one time use), which may obviate the burden of cleaning a bulk liquid transport. In other embodiments, any of the flexible containers described herein can be reusable. In some embodiments, after being used, a flexible container can be processed on-site in a cracker mill or the like configured to break down the flexible container in to small pieces, which in turn can be manufactured on-site and on-demand into a new flexible container. In some instances, the processing (e.g., the breaking down and/or the manufacturing) of flexible container can include cleaning the constituent material of any residue or the like left from the bulk liquid transported therein.

Any of the flexible containers described herein can be configured to store and/or transport heavy, dense, and/or highly viscous bulk liquids such as heavy crude oil, extra heavy crude oil, bitumen, and/or the like (generally referred to herein as "heavy oil"). The flexible containers can be constructed of a material and/or lined with a material configured to resist degradation resulting from corrosive materials or the like. In some embodiments, the flexible containers described herein can be transitioned between an expanded configuration in which the flexible container receives an inlet flow of a bulk liquid (e.g., heavy oil) and a collapsed configuration for storage and/or transport. In some embodiments, the arrangement of the flexible container in the collapsed configuration can be such that the bulk liquid forms a substantially rigid shape or the like. For example, in some instances, a negative pressure can be applied within the flexible container that draws the flexible container inward around the bulk liquid. In such instances, the negative pressure can be sufficient resist a deformation of the bulk liquid and/or flexible container under the force of gravity (e.g., resulting from its own weight) and/or under an externally applied force such as a force resulting from stacking a number of flexible containers (e.g., one on top of another) while in the collapsed configuration. In some instances, placing the flexible container in the collapsed configuration can be operable in removing volatile gas from, for example, a volume of heavy oil disposed therein.

In some known instances, the transport of heavy oil includes heavily diluting the heavy oil to increase a flowability (e.g., lower a viscosity) of the heavy oil. For example, tanker cars and/or other suitable storage containers can carry between eight and ten tons or more of a heavy oil product with 20 to 50% of the volume being diluents or highly volatile $C_5$ hydrocarbon and/or other gas/liquids. In some instances, storing and/or transporting heavy oil in the flexible containers described herein can obviate the use of diluents and/or can remove at least a portion of the volatile gasses from with the flexible container. This not only results in a safer means of storing and/or transporting heavy oil (e.g., considerably less volatile) but also, reduces and/or obviates a process of back hauling a diluent to its point of origin (e.g., refinery or the like). In addition, the heavy oil can be more efficiently refined into a range of energy products by obviating a diluent separation and/or removal process. In addition, in some instances, storing and/or transporting heavy oil with the flexible containers described herein can reduce or obviate a use of additional heating at delivery points (e.g., rail or truck to refineries).

In some embodiments, a flexible container can include one or more restrictors, compartments, chambers, baffles, and/or the like configured to at least partially separate an interior volume of the flexible container. As described above, in some instances, at least partially separating and/or dividing the flexible container can reduce load shifting of or wave generation in the bulk liquid including, for example, heavy and/or highly viscous liquids (e.g., heavy oil).

In some embodiments, any of the flexible containers described herein can include one or more inflatable bladders, ribs, buffers, and/or the like (referred to herein as bladders). The bladders can be disposed within an interior volume of the flexible container and/or outside of the interior volume (e.g., on an outer surface of the flexible container). In some embodiments, the bladders can be configured to protect the flexible container during loading, storage, and/or transport. In some instances, the bladders can be inflated with a cooling material such as water or the like configured to cool a bulk liquid disposed within the flexible container. In some such instances, the bladders and/or buffers can be inflated and/or otherwise engaged to act as a forming device or means configured to at least partially retain a shape of the flexible container when storing and/or transporting a bulk liquid. In instances in which the flexible container contains a heavy and/or highly viscous liquid such as heavy oil, the bladders can, for example, increase a buoyancy of the flexible container and the liquid contained therein. For example, in some instances, heavy oil and/or similar bulk liquids can have a density greater than water (e.g., the heavy oil and/or other liquids do not float). Some countries, cities, and/or ports may restrict the oceanic transport of liquids having a density that is greater than water. Thus, by disposing the heavy oil and/or other liquids in a flexible container including one or more bladders and shipping the flexible containers (inside a rigid shipping container or not) can be such that the cargo (e.g., one or more flexible containers containing a liquid) has a sufficient buoyancy to allow the flexible containers to float.

Figure 2:
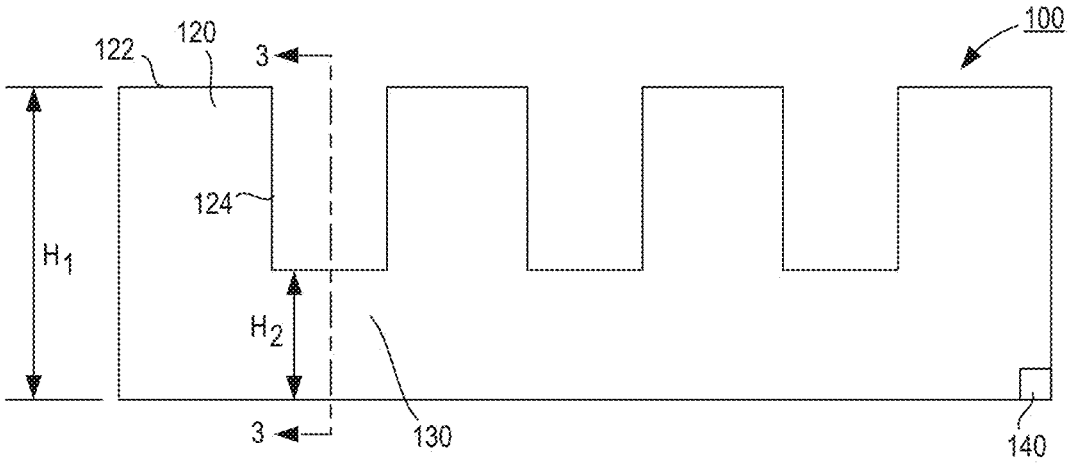
FIG. 2 is a side view illustration of the flexible container of FIG. 1.
Figure 3:
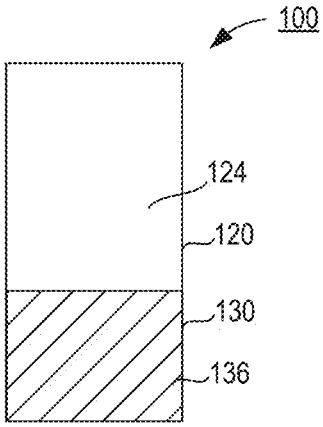
FIG. 3 is a cross-sectional view of the flexible container illustrated in FIG. 1 taken along line 3-3 in FIG. 2.

Referring now to FIGS. 1-3, a flexible container 100 is illustrated according to an embodiment of the present disclosure. The flexible container 100 is configured to contain a liquid substance (or "bulk liquid") for transportation within a dry van trailer and/or other suitable intermodal container. The flexible container 100 can have any suitable shape, size, or configuration. For example, as shown in FIG. 1, the flexible container 100 includes a series of container portions 120 (only one container portion is identified for simplicity of the drawings). Each container portion 120 includes an outer or "side" surface 124 and a top surface 122. A restriction portion 130 connects each adjacent container portion 120 (e.g., physically and fluidically connects). The flexible container 100 as shown in FIGS. 1 and 2 includes four container portions 120 and three restriction portions 130. In other embodiments, however, any suitable number of container portions 120 and/or restriction portions 130 can be included.

As shown in FIG. 2, the container portions 120 have a first height $H_1$ and the restriction portions 130 have a second height $H_2$. The second height $H_2$, is smaller than the first height $H_1$ so that the restriction portions 130 can limit the flow of fluid between adjacent container portions 120 and/or otherwise can dampen the forces exerted by the moving liquids (e.g., load shifting). The second height $H_2$ can be chosen to achieve the desired fluid flow and damping parameters. In addition to the damping resulting from the reduced second height $H_2$, the restriction portions 130 can include valves or active damping mechanisms between the container portions 120. Active damping mechanisms can include, for example, laminar flow elements and/or any other suitable device.

The flexible container 100 includes a port 140. The port 140 can be used both for loading the flexible container 100 with liquid and for unloading the liquid from the flexible container 100. Although the port 140 is shown at a bottom corner of the flexible container 100, in other embodiments, the port 140 can be located in other suitable positions on the flexible container 100, such as on the side or the top of the flexible container 100. In some embodiments, the top surface 122 of at least one of the container portions 120 can include a vent, valve, or filter (not shown) in order to prevent pressure from building up when the tank is being filled with liquid. The vent, valve, or filter can allow gas to exit while blocking the escape of liquid. In some instances, removing gas (e.g., oxygen) from the interior volume of the flexible container can reduce an amount and/or degree of refrigeration otherwise used for food grade bulk liquids and/or other temperature sensitive bulk liquids. In other words, removing the gas from the interior volume of the flexible container increases a storage temperature threshold (e.g., a maximum storage temperature). In embodiments in which the bulk liquid is a heavy oil or the like, such a vent or the like can be used to remove volatile gasses from the heavy oil, which in turn, can reduce a flammability and/or combustibility of the heavy oil (e.g., particularly when the heavy oil is diluted with highly volatile diluents). Although shown as including the port 140 on the container portion 120, in other embodiments, the port 140 can be disposed on any suitable portion of the flexible container 100 (e.g., the restriction portion 130). In other embodiments, the port 140 can be a relatively large opening through which the bulk liquid can be conveyed. For example, in some instances, bitumen (e.g., heavy oil) can be loaded into the flexible container 100 through the port 140, which can be a relatively large opening. In such embodiments, the flexible container 100 can include and/or can be coupled to a cover (e.g., via an adhesive, a zipper, or the like) configured to obstruct the opening. In yet other embodiments, the flexible container 100 need not include a port.

As described above, in some instances, the flexible container can be configured to receive and/or store heavy oil. In such instances, the heavy oil can be heated (e.g., as a result of extraction from the ground and/or via any other suitable heating method) to increase a flowability of the heavy oil, thereby allowing the heavy oil to be pumped into the flexible container 100. For example, the heavy oil can be heated to a temperature between about 176° Fahrenheit (F) and about 185° F. (80° Celsius (C) to 85° C.). In some embodiments, the flexible container 100 can be formed of a flexible, heat resistant material and/or can include an inner layer or lining formed of a flexible, heat resistant material.

Although not shown in FIGS. 1-3, the flexible container 100 can include any suitable feature and/or means for cooling the heavy oil contained in the flexible container 100. For example, as described above, the flexible container 100 can include and/or define a vent or port through which volatile gasses can exit the interior volume of the flexible container 100. In some instances, venting the volatile gasses can reduce a temperature of the heavy oil. In some embodiments, the flexible container 100 can include any suitable port or opening configured to receive a chilling device such as a cooling rod (or other suitable cooling element). Such a cooling rod can include a first end (e.g., a hot end) disposed in the heavy oil and a second end opposite the first end disposed outside of the flexible container 100. As such, the second end can be chilled (either actively or prior to use) to allow heat transfer from the first end to the second end, which in turn, can cool the heavy oil (including a core or center of the heavy oil typically remaining hot due to the high density of the heavy oil). In other embodiments, the flexible container 100 can include an active cooling system within the interior volume that can cool the heavy oil. For example, the active cooling system can circulate a cooling fluid through a series of conduits or the like. In some embodiments, the flexible container 100 can include a cooling fluid between an inner layer and an outer layer of the flexible container 100. In other embodiments, an inert gas (chilled or substantially at ambient temperatures) can be injected into the flexible container 100. For example, a chilled inert gas (e.g., a cooling element or the like) can be injected into the flexible container 100 to cool the heavy oil as well as to expel any volatile gasses produced by the heavy oil (e.g., through the vent as described above).

FIG. 3 is a cross-sectional view of the flexible container 100 taken along line 3-3 in FIG. 2. As identified in FIG. 3, the restriction portion 130 defines a rectangular cross-sectional flow area 136 between the adjacent container portions. The bottom side of the restriction portion 130 is coplanar with the bottom surface of the container portion 120. The restriction portion 130 has the same width as the container portion 120. Thus, the flow area 136 produces a flow restriction between the adjacent container portions 120 that is characterized by the difference between the first height $H_1$ and the second height $H_2$. The flow restriction can limit the flow between the adjacent container portions 120, thus limiting the dynamic forces that can result during transportation. Although the restriction portion 130 is shown as having a rectangular cross-sectional shape (or flow area 136), the restriction portion 130 can have any suitable cross-sectional shape. The cross-sectional shape of the restriction portion 130 can be chosen depending on the damping and fluid flow properties desired between the adjacent container portions 120.

Figure 4:
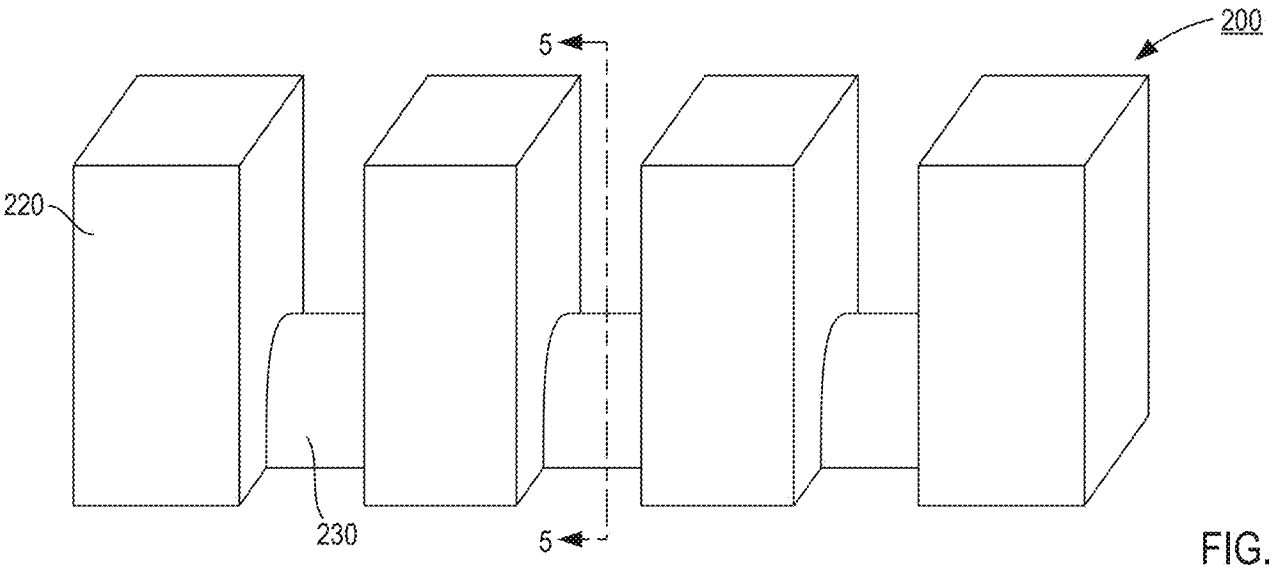
FIG. 4 is a perspective view illustration of a flexible container according to an embodiment.
Figure 5:
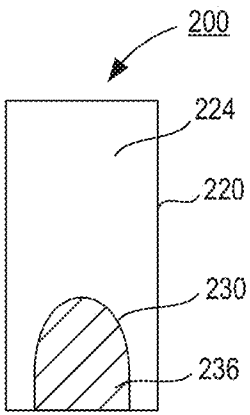
FIG. 5 is a cross-sectional view of the flexible container of FIG. 4 taken along the line 5-5.

While the restriction portion 130 of the flexible container 100 is particularly shown in FIGS. 1-3, a flexible container can include any number of restriction portions having any suitable configuration. For example, FIGS. 4 and 5 illustrate a flexible container 200 according to an embodiment. The flexible container 200 includes a set of container portions 220 separated by a set of restriction portions 230 (e.g., in an alternating arrangement). The flexible container 200 can be substantially similar in form and/or function to the flexible container 100 described above with reference to FIGS. 1-3. The flexible container 200 can differ, however, with the configuration and/or arrangement of the restriction portions 230. For example, as shown in FIGS. 4 and 5, the restriction portions 230 are narrower than the container portions 220 and have a substantially curved or arced top or overall shape. The container portion 220 includes an outer surface 224, and the restriction portion defines a flow area 236 between adjacent container portions 220, as shown in FIG. 5. In the embodiment shown in FIGS. 4 and 5, the restriction portion 230 defines a curved flow area 236, with a width that is narrower than the width of the container portion 220 and a bottom that is formed by and/or coplanar with a bottom of the container portion 220. In other embodiments, a flexible container can include a set of restriction portions each of which are narrower than a set of container portions each of which define a flow area having a substantially rectangular cross-sectional shape, a substantially triangular cross-sectional shape, an irregular cross-sectional shape, and/or any other suitable cross-sectional shape.

Figure 6:
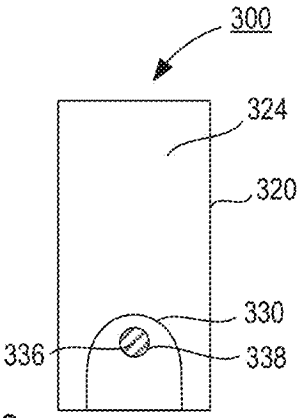
FIG. 6 is a cross-sectional view of a flexible container according to an embodiment.

FIG. 6 is a cross-sectional view (e.g., similar to that shown in FIG. 5) of a flexible container 300 according to an embodiment. As described above with reference to the flexible container 100, the flexible container 300 includes a series of container portions 320 and a series of restriction portions 330 disposed between the adjacent container portions 320 (only one container portion 320 and one restriction portion 330 are shown and described for simplicity). The container portion 320 includes an outer surface 324. The restriction portion 330 defines a flow opening 338 extending configured to form and/or define the flow area 336. The restriction portion 330 can have a size and/or shape similar to the restriction portion 230 described above with reference to FIG. 5. The restriction portion 330 can differ for the restriction portion 230, however, in the size and/or arrangement of the flow area 336. Specifically, as shown in FIG. 6, the restriction portion 320 can be substantially solid and can define the flow opening 338 configured to fluidically couple adjacent container portions 320. In some instances, reducing the flow area 326 (e.g., to an area of the flow opening 338) can restrict the flow of fluid between the container portions 320.

The restriction portion 330 can be arranged in any suitable manner. For example, while the restriction portion 330 is shown as defining the flow opening 338 in given position, in other embodiments, the restriction portion 330 can define the flow opening 338 at any suitable position. Moreover, while the restriction portion 330 is shown as defining a single flow opening 338, in other embodiments, the restriction portion 330 can define any suitable number of flow openings 330. Also, while FIG. 6 shows the flow opening 338 as being circular and a having a given size, the flow opening 338 can be formed as any suitable shape, such as a square, rectangular, triangular, etc. having any suitable size. Furthermore, while the flow opening 338 is shown extending through the restriction portion 330 with a substantially constant diameter, in other embodiments, a diameter of a flow opening may vary with position along the restriction portion. For example, in some embodiments, a restriction portion can include a tapered inner surface that defines a flow opening having a larger diameter at a portion adjacent the container portions 320 and a smaller diameter at a portion toward the center of the restriction portion. In other embodiments, a flow opening can be defined within any suitable cross-sectional shape that is either constant or varied along a length of the restriction portion.

Figure 7:
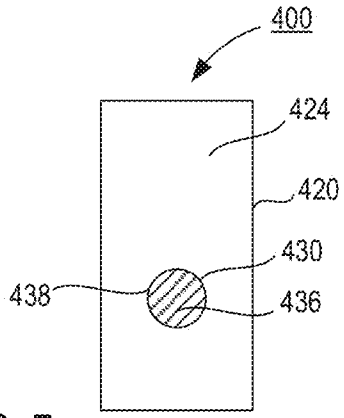
FIG. 7 is a cross-sectional view of a flexible container according to an embodiment.

FIG. 7 is a cross-sectional view (e.g., similar to that shown in FIG. 5) of a flexible container 400 according to another embodiment. The flexible container 400 includes a series of container portions 420 and a series of restriction portions 430 disposed between adjacent container portions 420 (only one container portion 420 and one restriction portion 430 are shown and described for simplicity). The container portion 420 includes an outer surface 424, and the restriction portion defines a flow area 426 between the adjacent container portions 220. In contrast to restriction portions 130, 230, and 330, the restriction portion 430 does not include a bottom surface that is coplanar with a bottom surface of the container portion 420. Instead, the restriction portion 430 includes a bottom that is located a distance above the bottom of the container portion 420. In some embodiments, for example, the restriction portions 430 can be a tube or conduit fluidically coupling adjacent container portions 320. The restriction portion 430 can be disposed at any suitable position relative to the container portions 420.

Figure 8:
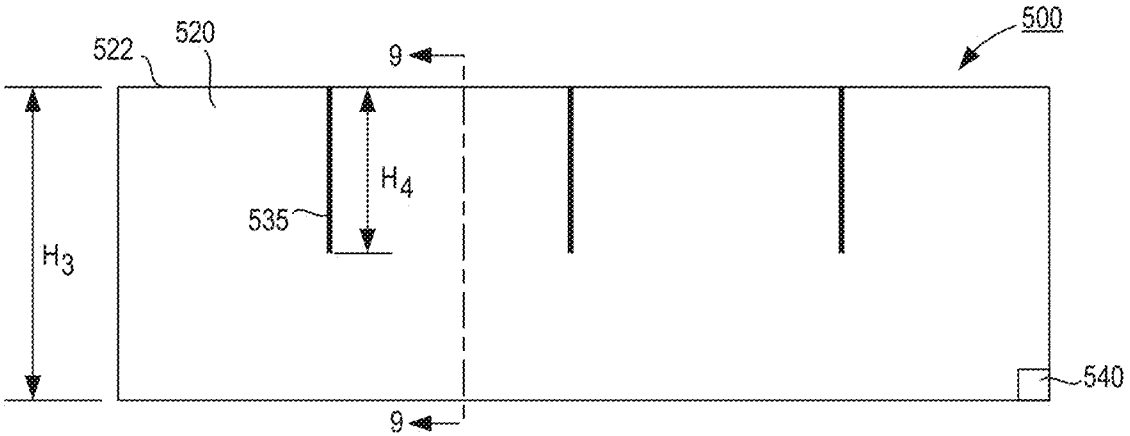
FIG. 8 is a cross-sectional side view of a flexible container according to an embodiment.
Figure 9:
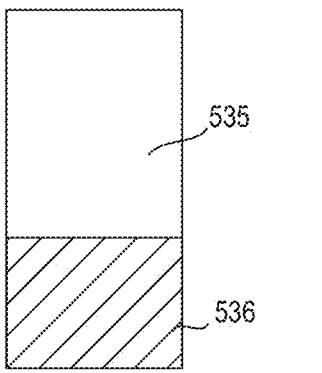
FIG. 9 is a cross-sectional view of the flexible container of FIG. 8 taken along line 9-9.

While the flexible containers 130, 230, 330, and 430 are shown as including the restriction portions disposed between the container portions 120, 220, 320, and 420, respectively, in other embodiments, a flexible container can include one or more baffles or the like that extend from an interior surface of the flexible container to at least partially define the container portions. For example, FIGS. 8 and 9 illustrates a flexible container 500 according to an embodiment. The flexible container 500 includes a set of baffles 535 that at least partially separate and/or divide the flexible container 500 into container portions 520. The baffles 535 can be any suitable shape, size, and/or configuration. For example, in some embodiments the baffles 535 can be flaps or any other suitable movable and/or flexible structures. The flaps can extend from one or more of any of the sides of any of the flexible container 500 and can have an attached end and a freely movable end. In some embodiments, a series of baffles 535 (e.g., flaps) can be offset along the length of a tank.

While three baffles 535 are shown in FIG. 8, any suitable number of baffles can be included in the flexible container 500. The baffles 535 extend from the top of the flexible container 500 toward the bottom of the flexible container 500. The flexible container 500 has a first height $H_3$ and the baffles 535 have a second height $H_4$ that is less than the first height $H_3$. The baffle height $H_4$ can be chosen based on the desired fluid flow parameters (e.g., viscosity, wave generation, weight, etc.).

While FIG. 8 shows the baffles 535 projecting down into the flexible container 500 from the top of the flexible container 500, the baffles 535 can project inwardly from any one or more of the sides of the flexible container 500. In some embodiments, a series of baffles 535 can be offset along the length of the flexible container 500. For example, a first baffle 535 can project from a right side of the flexible container 500, and a second baffle 535 can project from the left side, etc. The baffles 535 can project inwardly any suitable distance. In some embodiments, a flexible container 500 can include several baffles 535 that project different distances into the flexible container. For example, in some embodiments, the height $H_4$ of the baffles 535 can decrease from a first height of a middle baffle (or a middle pair of baffles) to a second height of the outermost baffles.

The baffles 535 can be monolithically formed with the flexible container 500 (e.g., constructed of a single piece of polypropylene), welded to the flexible container 500, and/or joined to the flexible container 500 by any other suitable means. In some embodiments, a baffle 535 can have a greater rigidity than the walls of the flexible container 500 and/or can be reinforced. For example, a baffle 535 can be operable to resist at least a portion of the force associated with a hydrodynamic wave. In some embodiments, a portion of the baffle 535 can be sealed and inflated. In some instances, a gas used to inflate the baffle 535 can be cooled, which in turn, cools the baffles 535. In this manner, the baffles 535 can be configured to absorb at least a portion of heat from the bulk liquid (e.g., heavy oil) contained in the flexible container 500.

The flexible container 500 includes a port 540. The port 540 can function similarly and include similar features to the port 140 described with reference to the flexible container 100 above, and thus, is not be further described here.

As shown in FIG. 9, the baffle 535 projects from the top of the flexible container 500 toward the bottom and defines a rectangular cross-sectional flow area 526 between the adjacent container portions. The reduced flow area 526 (e.g., resulting from the baffles 535) results in a flow restriction between the adjacent container portions that is characterized by the difference between the first height $H_3$ and the second height $H_4$. The flow restriction can limit the flow between the adjacent container portions 520, thus limiting the dynamic forces that can result during transportation. Although the flow area 526 is shown as having a rectangular cross-sectional shape, the flow area 526 can have any suitable cross-sectional shape. The cross sectional shape of the flow area 526 can be chosen depending on the damping and fluid flow properties desired between the adjacent container portions 520 (e.g., as described above with reference to the restriction portion 130 of FIGS. 1-3).

Figure 10:
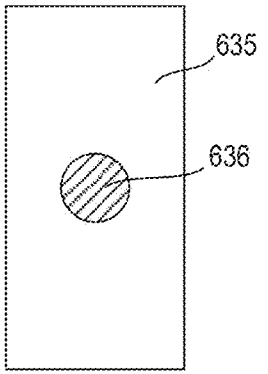
FIG. 10 is a cross-sectional view of a flexible container according to an embodiment.

FIG. 10 is a cross-sectional view (e.g., similar to that shown in FIG. 9) of a flexible container 600 according to an embodiment. The flexible container 600 includes a series of baffles 635 that divide the flexible container 600 into container portions (not shown) (only one baffle 635 is shown and described for simplicity). In some embodiments, the baffle 635 can be substantially similar in form and/or function to the baffle 535 described above with reference to FIGS. 8 and 9. In the embodiment shown in FIG. 10, however, the baffle 635 defines a circular flow area 626 between the adjacent container portions. In some embodiments, the baffle 635 can have substantially the same height as the container portions. That is to say, the baffles 635 can extend the full height of the flexible container 600. Defining a circular flow area 626 at a desired distance along a surface of the baffle, can result in a desired restriction in flow between adjacent container portions. While FIG. 10 shows only one flow area 626 disposed in a given position, a baffle can define any suitable number of flow areas defined at any suitable position along the baffle 635. Also, while FIG. 10 shows the flow area 626 as being circular having a given diameter, the flow area 626 can be formed as any suitable shape, such as a square, rectangular, triangular, etc. with any suitable size. In some embodiments, the series of baffles 635 can define flow areas that are misaligned and/or offset from each other to produce a tortuous path through several container portions, thereby increasing the damping effect.

Figure 11:
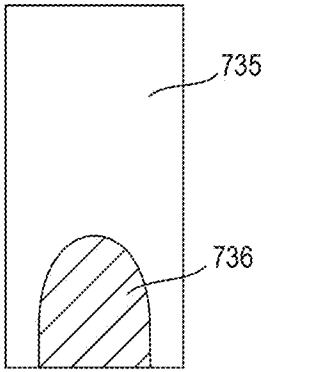
FIG. 11 is a cross-sectional view of a flexible container according to an embodiment.

FIG. 11 is a cross-sectional view (e.g., similar to that shown in FIG. 9) of a flexible container 700 according to an embodiment. The flexible container 700 includes a series of baffles 735 that divide the flexible container 700 into container portions (not shown) (only one baffle 735 is shown and described for simplicity). In some embodiments, the baffle 735 can be substantially similar in form and/or function to the baffle 535 described above with reference to FIGS. 8 and 9. In the embodiment shown in FIG. 11, however, the baffle 735 defines a curved flow area 726 between the adjacent container portions that results in a flow restriction between the adjacent container portions. In some embodiments, the flow area 736 can have a substantially similar cross-sectional shape as the flow area 236 described above with reference to FIG. 5. For example, the flow area 726 has a width that is narrower than the width of the baffle 735. The bottom of the flow area 726 is coplanar with the bottom of the baffle 735. The flow area 726 has a curved top. Although the flow area 726 is shown to have a curved shape, it may have any suitable shape depending on the damping and fluid flow properties desired between the adjacent container portions. In some embodiments, the series of baffles 735 can define flow areas that are misaligned to produce a tortuous path between several container portions, thereby increasing the damping effect.

Figure 12:
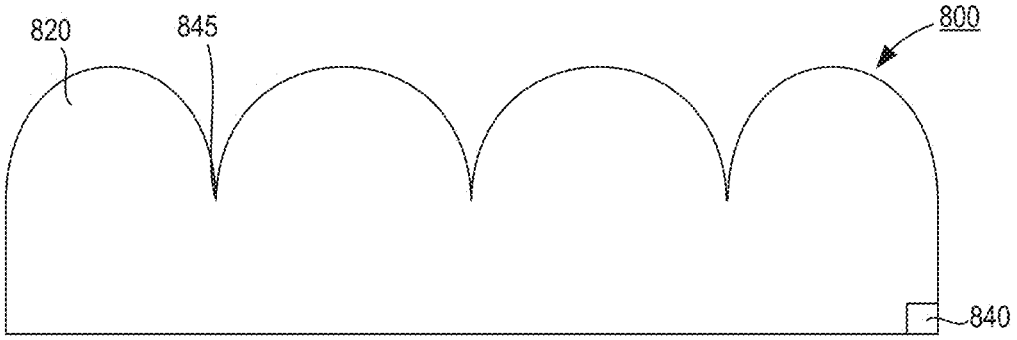
FIG. 12 is a cross-sectional side view of a flexible container according to an embodiment.

FIG. 12 is a cross-sectional side view of a flexible container 800 according to an embodiment. The flexible container 800 can be a bag or any other suitable flexible container such as those described herein. The flexible container 800 includes a series of crimps 845. The crimps 845 separate and/or divide the flexible container 800 into a series of container portions 820 as described about with reference to the restriction portions. The crimps 845 can be, for example, a mechanical pinching and/or deforming of the tank during or after the manufacturing process to inexpensively and safely restrict the movement of waves of fluid when the flexible container 800 is in use.

Figure 13:
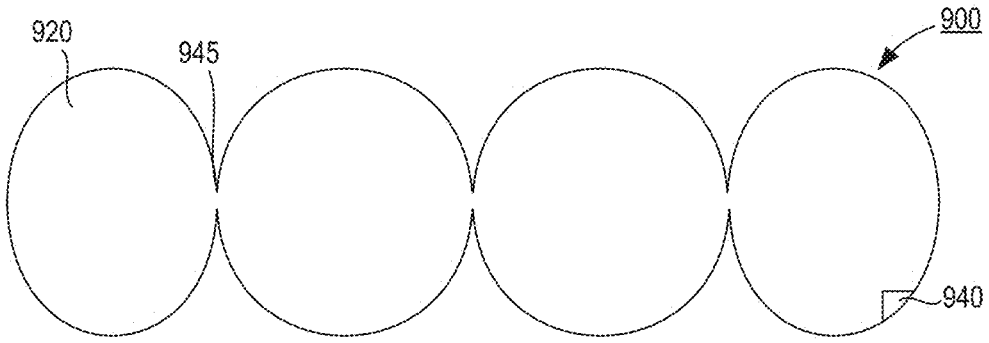
FIG. 13 is a cross-sectional side view of a flexible container according to an embodiment.

In some embodiments, a 180 degree crimp can be applied to the flexible container 800, as shown in FIG. 12. In other embodiments, a 360 degree crimp can be applied to the flexible container. For example, FIG. 13 illustrates a flexible container 900 according to an embodiment that includes a series of crimps 945. The crimps 945 substantially circumscribe the flexible container 900 (e.g., the crimps 945 are 360 degree crimps) and separate and/or divide the flexible container 900 into a series of container portions 930 (as described in detail above).

In other embodiments, any suitable crimp may be applied to the flexible container (e.g., between 180 and 360 degrees or less than 180 degrees). In some embodiments, the crimps can be offset. For example, a first crimp can be a 180 degree crimp disposed towards the bottom of the flexible container, a second adjacent crimp can be a 180 degree crimp disposed towards the top and/or side of the flexible container, and so forth. Similarly, the degree of the crimps can vary along the flexible container. For example, the first crimp can be a 90 degree crimp, the second adjacent crimp can be a 180 degree crimp, and a third crimp adjacent to the second crimp can be a 360 degree crimp. It should be understood that these embodiments are given by way of example only. Other embodiments are possible with any suitable arrangement of crimp position and/or degree of crimp.

Tubes of polyethylene or other materials can be crimped at specified intervals during the manufacturing process and cut, or sized, to specific standard trailer lengths and widths. Alternatively, tubes of polypropylene may be mechanically crimped after the manufacturing process to the required length and width. Crimping after the manufacturing process will have specific economic benefits in that rolls of the tubes can be stored in depot sites set up along the trading routes and sized on demand to specific trailer sizes and requirements.

The restrictions imposed by the crimping disrupt the wave action of the liquid sufficiently to reduce the force placed on the flexible container ends and sides and the trailer ends and sides. These crimps do not significantly restrict the load size and allow for efficient loading and unloading of the product.

As shown in FIGS. 12 and 13, the flexible containers 800 and 900, respectively, include a port 840 and 940, respectively. The ports 840 and/or 940 can function similarly to and can include similar features as the port 140 described with reference to the flexible container 100 above, and thus, are not described in further detail herein.

Figure 14:
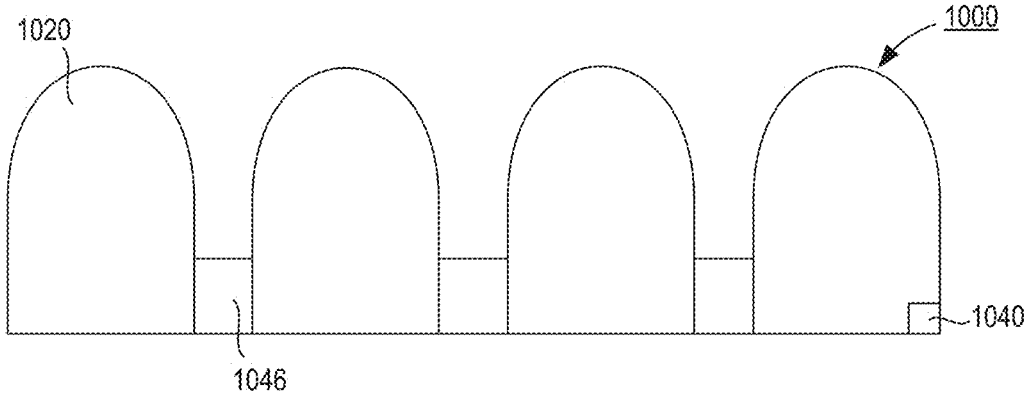
FIG. 14 is a cross-sectional side view of a flexible container according to an embodiment.

FIG. 14 is a cross-sectional side view of a flexible container 1000 according to an embodiment. The flexible container 1000 includes a series of bands 1046 that separate and/or divide the flexible container 1000 into a series of container portions 1020. Although three bands 1046 are shown, any suitable number of bands may be included. For example, in some embodiments, a 53 foot flexible container could include five bands. The bands 1046 may have various thicknesses. For example, the bands 1046 can vary in width from about 2 in. to about 6 in., or can be wider than about 6 in. The thicknesses may be selected to achieve different damping and fluid flow properties between the container portions 1020. Typically, it is understood that wider bands 1046 correlate to more restricted fluid flow between the container portions 1020. Additionally, the wider the band 1046 placed on the flexible container 1000, the smaller the volume of the flexible container 1000 available to be filled with product. The selection of thicknesses of the bands 1046 and the selection of the interval distance between the bands 1046 can be based in part on the material to be transported by the flexible container 1000 and the conditions of transportation. The selection of thickness of band 1046 can take into account the viscosity and weight of the product, and the height of the flexible container 1000 may increase or decrease according to the width of the band 1046 and type of product. The bands 1046 can be elastic or inelastic, and can be arranged to fully separate or partially separate the container portions 1020. The bands 1046 can be made from any suitable material. For example, the bands 1046 can be made from rubber and/or high tensile fabric.

The flexible container 1000 includes a port 1040. The port 1040 can function similarly and include similar features to the port 140 described with reference to the flexible container 100 above, and thus, is not described in further detail herein.

Figure 15:
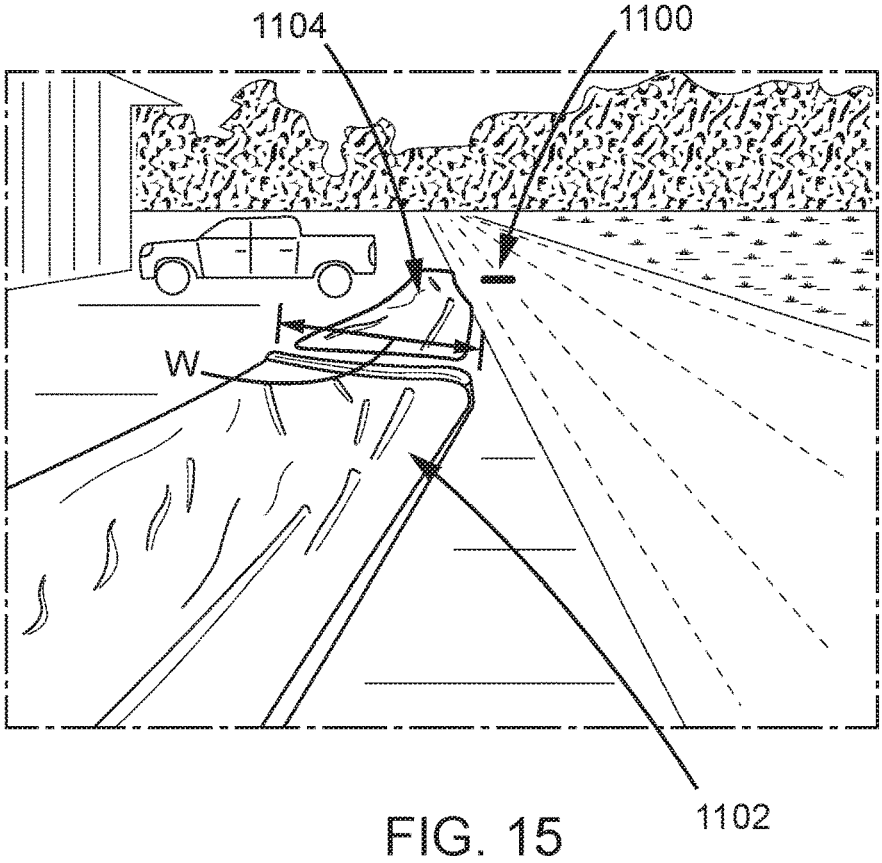
FIGS. 15 and 16 show a flexible container according to an embodiment, in a collapsed configuration and an expanded configuration, respectively.
Figure 16:
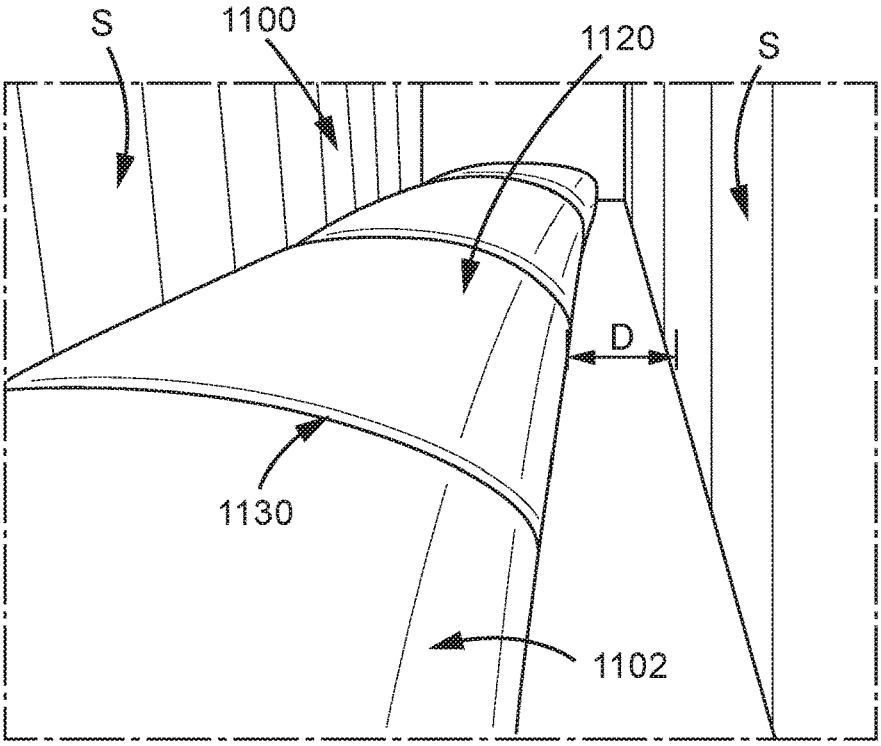

Any of the flexible containers described herein can include an outer layer and an inner layer. The outer layer can include a protective cover bag. The inner layer can include a food grade bag, a heat resistant bag, and/or any other suitable bag. For example, FIGS. 15 and 16 illustrate a flexible container 1100 according to an embodiment. As shown in FIG. 15, the flexible container 1100 includes an outer layer 1102 and an inner layer 1104. FIG. 15 shows the flexible container 1100 in an unassembled, unexpanded configuration in which the inner layer 1104 is not yet arranged within the outer layer 1102. FIG. 16 shows the flexible container 1100 in an assembled, expanded configuration in which a series of bands 1130 have been secured around the outer layer 1102, dividing the flexible container 1100 into a series of container portions 1120 (as described above with reference to the flexible container 1000 in FIG. 14). In this configuration, the movement of fluid between the container portions 1120 is inhibited due to the series of bands 1130 constricting both the outer layer 1102 and the inner layer 1104.

Alternatively, rather than securing a series of bands on the outside of the outer layer of the flexible container, a series of bands can be disposed between the outer layer and the inner layer and constrict only the inner layer. Additionally, in an embodiment that includes a series of crimps rather than a series of bands, similar to the embodiment shown in FIG. 12, the outer layer and the inner layer can both be crimped, or only the inner layer can be crimped.

The flexible container 1100 also has a width W, as shown in FIG. 15. The width W can be sized such that when the flexible container 1100 is in a configuration where the flexible container 1100 has been loaded into a trailer with side walls S, as shown in FIG. 16, the sides of the flexible container 1100 can be in contact with or move into contact with the side walls S of the trailer. In some embodiments, the flexible container 1100 can be sized so that it is positioned a distance D from at least one of the side walls S. However, the distance D should be small enough that the flexible container 1100 can contact at least one of the side walls S, thereby hindered from substantially rolling. The width W of the flexible container 1100 can be selected according to the width of the trailer and/or shipping container that will be used to transport the flexible container 1100. Trailers, for example, vary in size and the width W of the flexible container 1100 can be chosen according to the width of the trailer. For example, the width of a flexible container in a standard trailer in the United States can be at least about 110 in. In some embodiments, the width W of the flexible container 1100 can vary based on the standard infrastructure in the region of use. The ratio of the width W of the flexible container 1100 to the standard trailer width can be between about 0.95 and 0.98, between about 0.90 and 0.98, between about 0.85 and 0.98, between about 0.80 and 0.98, and between about 0.75 and 0.98.

The width W of the flexible container 1100 should also be sized such that it is wide enough that the bottom surface (not shown) of the tank is substantially flat when the flexible container 1100 is filled with product. The substantially flat bottom surface of the flexible container 1100 helps to hinder the flexible container 1100 from rolling when compared to a tank with a curved bottom surface.

In some embodiments, the flexible container 1100 can include a side bumper (not shown). The side bumper can be attached to the outer surface of the flexible container 1100 and can provide a more robust contact region between the flexible container 1100 and the side walls S of the trailer. The side bumper can be integrally formed with the flexible container 1100. Alternatively, the side bumper can be separately constructed and attached to the flexible container 1100. In some embodiments, the side bumper can circumscribe the outer surface of the flexible container 1100. Alternatively, the side bumper can be formed in two portions that are attached to the sides of the flexible container 1100 that may move into contact with the side walls S of a trailer, leaving the ends of the flexible container 1100 without a side bumper.

Any of the flexible containers described herein can be disposed and/or coupled within a rigid shipping container and/or dry box van to form a shipping system that is devoid of a dunnage bag, bulwark, bulkhead, and/or any other mechanism for absorbing a load produced by the movement of the bulk material (e.g., bulk liquid) within the flexible containers. In particular, as described above, when a flexible container is moved from the expanded configuration to the collapsed configuration, the bulk liquid therein can be moved from a flowable (or partially flowable) state to a substantially non-flowable state. Thus, the potential of load shifting of the bulk material within the flexible container is reduced and/or eliminated. Accordingly, the flexible container can be coupled within a rigid container solely with a tether or strap (i.e., without the need for a bulwark, dunnage bag or the like).

Figure 17:
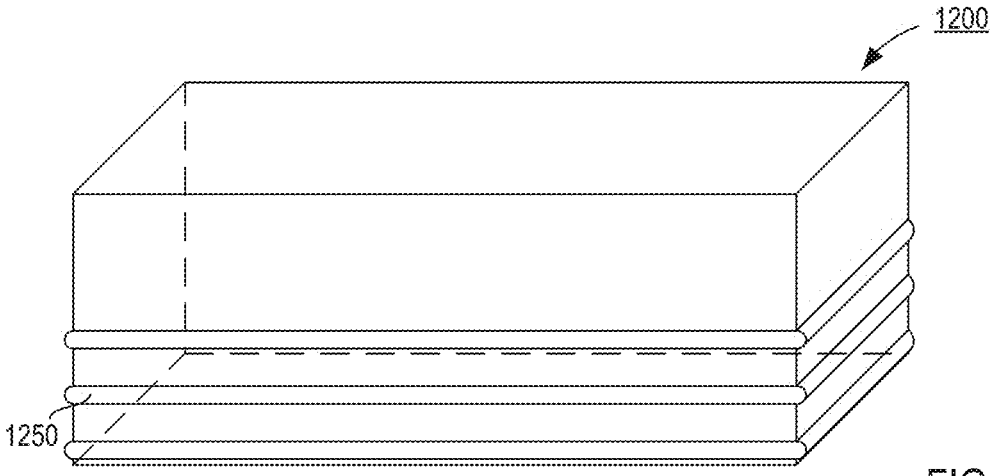
FIGS. 17-19 are each perspective views of at least a portion of a flexible container according to different embodiments.

In some embodiments, any of the flexible containers described herein can include one or more bumpers, pads, bladders, buffers, and/or the like configured to support and/or protect the flexible containers as well as reduce a likelihood of load shifting when the flexible containers are disposed in a rigid shipping container. For example, FIGS. 17-19 each depict at least a portion of a flexible container (which can be similar to any of the flexible containers described herein or portions thereof) with various configurations of buffer ribs (e.g., bladders, bumpers, etc.). FIG. 17, for example, illustrates at least a portion of a flexible container 1200 having buffer ribs 1250 extending circumferentially around a portion of the flexible container 1200. In some embodiments, the portion of the flexible container 1200 shown in FIG. 17 can be, for example, a container portion or a base portion (e.g., collectively formed by a set of restriction portions and a set of container portions, excluding a region of the container portions with a height greater than the restriction portions (see e.g., FIGS. 1 and 2)). In some embodiments, the portion of the flexible container 1200 can be substantially the entire flexible container. Although not shown in FIG. 17, the flexible container 1200 can include any number of restriction portions such as those described herein.

Figure 18:
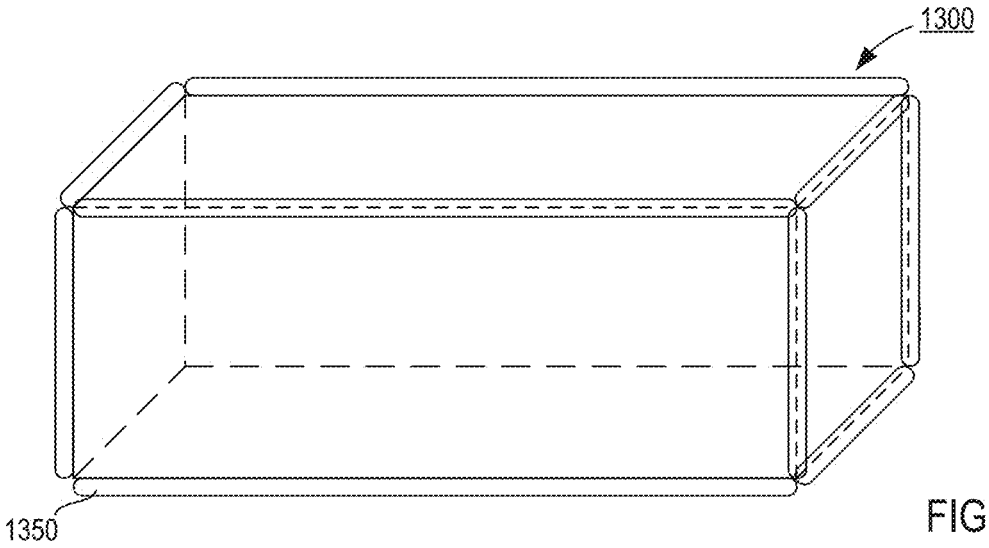
Figure 19:
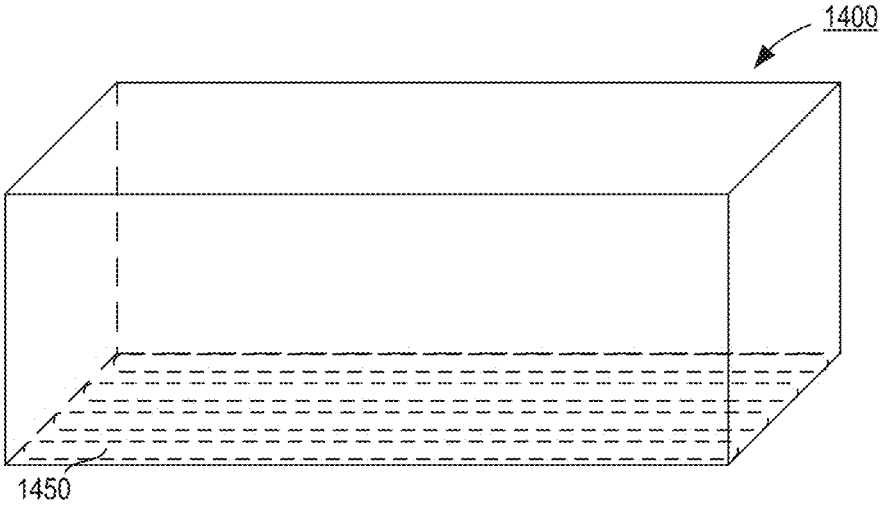

The buffer ribs 1250 coupled to the flexible container 1200 can be operable to resist movement of the flexible container 1200 when it is disposed within, for example, a rigid shipping container and/or a dry box van. For example, the buffer ribs, 1250 can be inflated to a desired amount to take up excess space between the flexible container 1200 and the shipping container. In some embodiments, the amount of inflation can account for and/or otherwise accommodate differences in storage area of the shipping container. Although not shown in FIG. 17, the buffer ribs 1250 can include any suitable port, valve, nozzle, and/or the like configured to provide a means of inflation and/or deflation. FIG. 18 illustrates a flexible container 1300 having buffer ribs 1350 disposed on the edges of the flexible container 1300. The flexible container 1300 and the buffer ribs 1350 can be substantially similar in form and/or function as the flexible container 1200 and the buffer ribs 1250 shown in FIG. 17. FIG. 19 illustrates a flexible container 1400 having buffer ribs 1450 disposed on a bottom surface of the flexible container 1400. The flexible container 1400 and the buffer ribs 1450 also, can be substantially similar in form and/or function as the flexible container 1200 and the buffer ribs 1250 shown in FIG. 17. In other embodiments, buffer ribs can be disposed on any surface, edge, corner, etc. of a flexible container. In some embodiments, the buffer ribs can be disposed within the flexible container.

In some embodiments, the buffer ribs 1250, 1350, and/or 1450 can be, for example, inflatable bladders. The bladders can be disposed within an interior volume of the flexible container and/or outside of the interior volume (e.g., on an outer surface of the flexible container). In some embodiments, the bladders can be configured to protect the flexible container during loading, storage, and/or transport. As described above, the bladders can be inflated to fill a space otherwise existing between the flexible container and a side wall of a shipping container and/or dry box van. In some instances, the bladders can be inflated with a cooling material such as water, a refrigerant, and/or the like configured to cool a bulk liquid disposed within the flexible container. For example, in some instances, heavy oil is heated to increase a flowability of the material and once contained inside a flexible container it may be desirable to cool the heavy oil. Thus, the cooling material within the inflatable bladders can be configured to remove heat from the bulk material within the flexible container. In some instances, the inflatable bladders can maintain the flexible container in a relatively fixed shape and/or form.

In instances in which the flexible container contains a heavy and/or highly viscous liquid such as heavy oil, the bladders can, for example, increase a buoyancy of the flexible container and the liquid contained therein. For example, in some instances, heavy oil and/or similar bulk liquids can have a density greater than water (e.g., the heavy oil and/or other liquids do not float). Some countries, cities, and/or ports may restrict the oceanic transport of liquids having a density that is greater than water. Thus, by disposing the heavy oil and/or other liquids in a flexible container including one or more bladders and shipping the flexible containers (inside a rigid shipping container or not) can be such that the cargo (e.g., one or more flexible containers containing a liquid) has a sufficient buoyancy to allow the flexible containers to float.

Any of the flexible containers described herein can be collapsible so that it can be easily moved and positioned in a desired location before and/or after being filled. As the flexible container is filled, the flexible container transitions from a storage and/or pre-use configuration, which may be substantially flat, folded, and/or rolled, to an expanded configuration. The flexible container may be made of a material that is stiffer on the bottom of the flexible container than on the top in order to maintain the shape and increase the durability of the flexible container. The flexible container can also be made of two separate materials each having a different stiffness. The stiffer material can form the bottom of the flexible container and the less stiff material can form the top of tank. In some embodiments, the bottom portion, for example, can be sufficiently stiff to allow for one or more flexible containers containing a bulk liquid such as heavy oil to be stacked substantially without deforming. In some embodiments, a restriction portion can be constructed of a more compliant (i.e., lower stiffness) material such as a mesh and/or lattice structure. Such construction can allow the restriction portion to deform when exposed to dynamic pressure waves, thereby absorbing the energy from the waves. Additionally, the flexible container can be made of a material or at least partially coated with a material that is textured and/or sticky so that the flexible container is inhibited from sliding by friction.

In some embodiments, the flexible containers described herein can be transitioned between an expanded configuration in which the flexible container receives an inlet flow of a bulk liquid (e.g., heavy oil) and a collapsed configuration for storage and/or transport. In some embodiments, the arrangement of the flexible container in the collapsed configuration can be such that the bulk liquid forms a substantially rigid shape or the like. In some instances, for example, the bulk liquid such as heavy oil or the like can be transitioned from a flowable state to a semi- or quasi-solid state in which the bulk liquid is substantially non-flowable. For example, in some instances, a negative pressure can be applied within the flexible container that draws the flexible container inward around the bulk liquid. In such instances, the negative pressure can be sufficient resist a deformation of the bulk liquid and/or flexible container under the force of gravity (e.g., resulting from its own weight) and/or under an externally applied force such as a force resulting from stacking a number of flexible containers (e.g., one on top of another) while in the collapsed configuration. In some instances, placing the flexible container in the collapsed configuration can be operable in removing volatile gas from, for example, a volume of heavy oil disposed therein.

Figure 20:
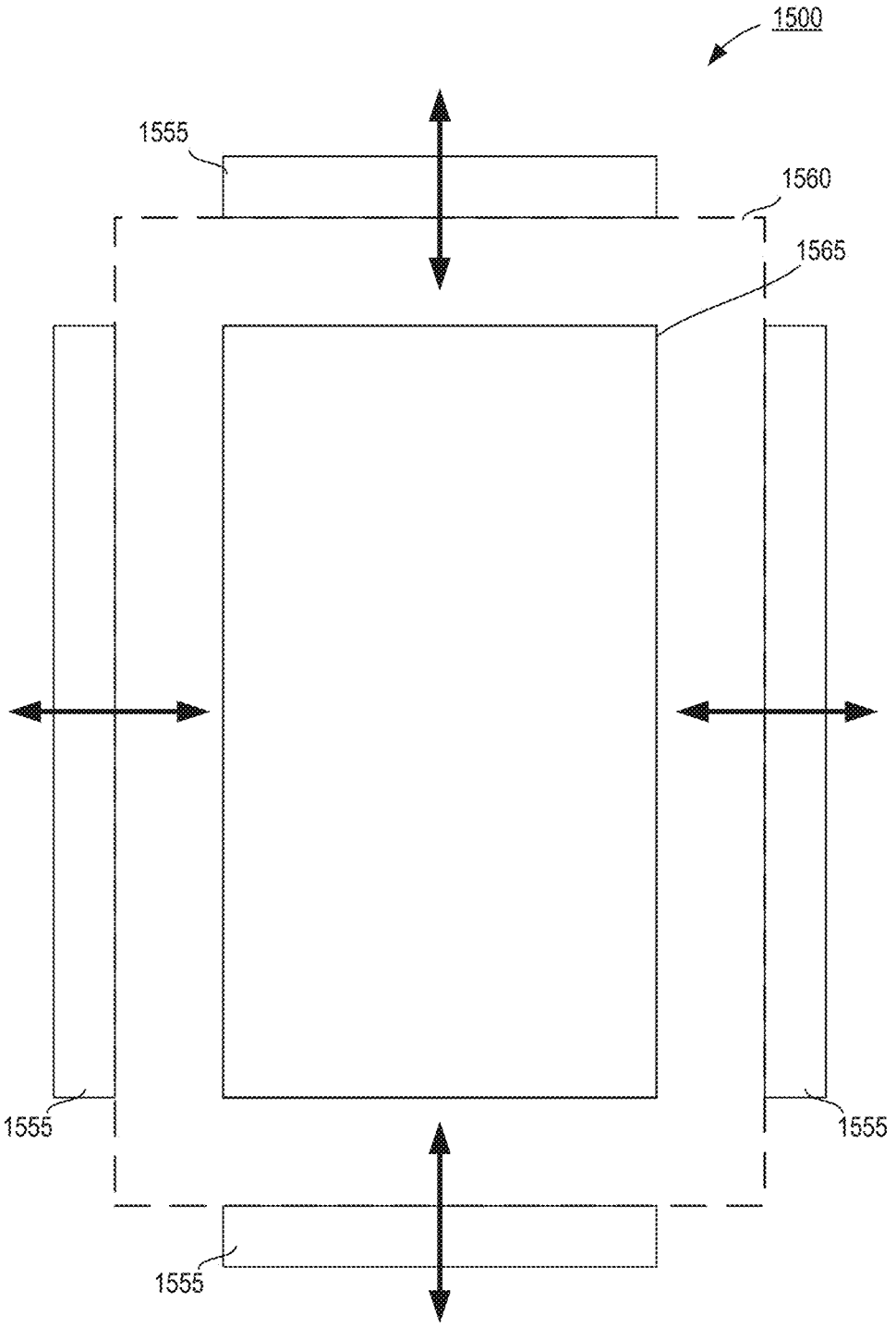
FIG. 20 is a schematic illustration of a system for transitioning a flexible container to a collapsed configuration according to an embodiment.

In some embodiments, any of the flexible containers described herein can be loaded and/or processed by a device configured to compress, shape and/or prepare the flexible container for disposition within a rigid container (e.g., any of the containers described herein). For example, FIG. 20 is a schematic diagram of a forming device 1500 for shaping flexible containers prior to placement within a rigid shipping container. The forming device 1500 can be any suitable device or mechanism configured to selectively exert a pressure on an exterior portion of the flexible container. As shown, the forming device 1500 has two pairs of movable members 1555. The forming device 1500 can be operable to control the size and/or shape of a flexible container while the flexible container is moving from an expanded configuration (indicated by the dashed lines identified as 1560) to a collapsed configuration (indicated by the solid lines identified as 1565). In some embodiments, moving the flexible container from the expanded configuration 1560 to a collapsed configuration 1565 without the forming device 1500 can result in the collapsed configuration 1565 having an irregular shape, such as bowed sides, that can be difficult to stack and/or position within a rigid container for shipping. The forming device 1500 and more specifically, the movable members 1555 can apply a force to the flexible container, such that gas is purged from the flexible container (e.g., volatile gas produced by heavy oil or the like). In response, the flexible container assumes a regular shape when placed in the collapsed configuration 1565. The movable members 1555 can be driven by a hydraulic or pneumatic pump, electric motor, internal combustion engine, and/or any other suitable means of applying the force to the flexible container. In other embodiments, the movable members 1555 can be inflatable. For example, in some embodiments, the movable members 1555 can be inflatable bladders and/or buffer ribs such as those described above with reference to FIGS. 17-19.

The pressure inside the flexible container can be reduced while the movable members 1555 compact the flexible container. In some embodiments, the flexible container in the collapsed configuration 1565 can assume a relatively rigid form with relatively flat side walls. For example, in embodiments where the internal volume of the flexible container includes a bulk liquid with a high viscosity (e.g., heavy oil), the collapsed configuration 1560 can include approximately no headspace that would otherwise allow a portion of bulk liquid to move relative to another portion of the bulk liquid. The forming device 1500 can be operable to urge the flexible container to assume a collapsed configuration with a flat bottom, top, and/or sides, which can be conducive to stacking and/or loading the flexible container within a rigid shipping container. Moreover, when a vacuum is applied to the interior volume of the flexible container, a negative pressure therein and the force exerted by the movable members 1555 move the flexible container into a collapsed configuration in which, a force exerted by the weight of the liquid contained therein that would otherwise result in a flow of the liquid is less than a negative pressure within the interior volume. Thus, by placing the flexible container in the collapsed configuration 1565 via the form, the flexible container retains a substantially consistent shape.

The movable members 1555 can retract once the flexible container is in the collapsed configuration 1565, which can allow the flexible container to be removed from the form. The flexible container in the collapsed configuration 1565 can retain the shape of the forming device 1500 after being removed. Thus, in some embodiments, flexible containers can be filled and moved into a collapsed configuration 1565, and then stacked and/or staged for later shipment. In such an embodiment, the flexible containers in the collapsed configuration 1565 can be loaded into a rigid shipping container.

Although two pairs of movable members 1555 operable to compact the length and width of the flexible container are shown in FIG. 20, in other embodiments the forming device 1500 can include any number of movable members. For example, a single movable member can be operable to compact the flexible container by applying a force to one side of the flexible container while, for example, the bottom and three other sides are stationary. In another embodiment, the forming device 1500 can include six movable members, operable to compact the flexible container in three orthogonal dimensions.

Although not shown in FIG. 20, in some embodiments, the forming device 1500 can be configured to cool and/or chill the bulk liquid within the flexible container as the flexible container is transitioned to the collapsed configuration. For example, in some embodiments, the movable members 1555 can be cooled and/or otherwise operably coupled to a cooling or chilling device. In other embodiments, any of the methods and/or devices described herein for cooling and/or chilling the bulk liquid contained in the flexible container can be used, for example, as the forming device 1500 exerts the force to transition the flexible container to the collapsed configuration.

By way of example, a flexible container can receive a volume of heavy oil that was preheated to increase a flowability associated with the heavy oil. The movable members 1555 of the forming device 1500 can be moved to exert a force on the flexible container operable to transition the flexible container from the expanded configuration 1560 to the collapsed configuration 1565 (see FIG. 20). As the forming device 1500 (e.g., the movable members 1555) exert(s) the force on the flexible container, a chilled inert gas can be pumped into the interior volume of the flexible container (e.g., via a first port) to cool the heated heavy oil contained therein. In addition, a vacuum and/or negative pressure can be applied and/or exerted in or on the interior volume (e.g., via a second port) to evacuate a gas contained therein (e.g., a relatively hot gas composed of volatile gases produced by the heated heavy oil and a portion of the inert gas, heated by the heavy oil). In this manner, the heavy oil and/or any other bulk liquid contained in the flexible container can be cooled and/or chilled as the flexible container is transitioned from the expanded configuration to the collapsed configuration. In some instances, the cooling and/or chilling of, for example, the heavy oil can sufficiently reduce a flowability of the heavy oil such that the flexible container, in the cooled, collapsed configuration, forms a substantially rigid shape. In some instances, the cooling and/or chilling of the bulk liquid (e.g., the heavy oil) can be such that the bulk liquid, including at a core of the bulk liquid, has a temperature substantially equal to an ambient temperature or any other suitable temperature such that storage of the bulk liquid within the collapsed flexible container does not include actively cooling the bulk liquid. In other embodiments, the bulk liquid can be actively cooled within the flexible container during loading, storage, and/or shipping/transport.

Figure 21:
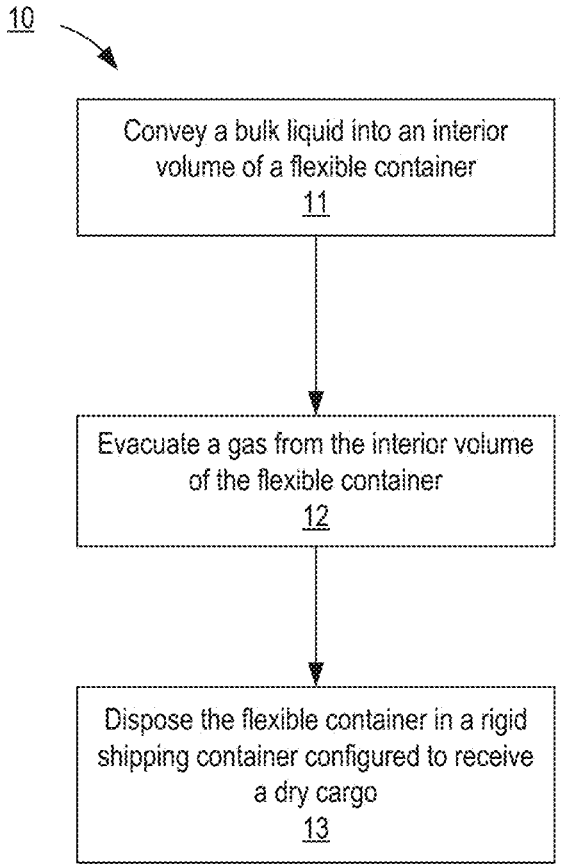
FIG. 21 is a flowchart illustrating a method for packaging bulk liquids according to an embodiment.

FIG. 21 is a flowchart illustrating a method 10 of packaging bulk liquids according to an embodiment. The method 10 includes conveying a bulk liquid into an interior volume of a flexible container at 11. The flexible container can be any suitable flexible container configured to receive a bulk liquid such as those described herein. For example, in some embodiments, the flexible container can be substantially similar to the flexible container 100 described above with reference to FIGS. 1-3. In other embodiments, the flexible container can be substantially similar to the flexible container 1000 described above with reference to FIGS. 15 and 16. Thus, the flexible container can include, for example, a set of container portions and a set of restriction portions, with each restriction portion being disposed between a pair of container portions. As described in detail herein, the restriction portions are configured to limit a flow of the bulk liquid between the container portions.

The bulk liquid can be any of the bulk liquids described herein. For example, in some embodiments, the bulk liquid can be a food grade liquid, a chemical grade liquid, a pharmaceutical grade liquid, and/or the like. In other embodiments, the bulk liquid can be a petroleum product such as, for example, gasoline and/or crude oil. In some embodiments, the bulk liquid can be heavy oil such as those described herein.

During the conveying of the bulk liquid or after the conveying of the bulk liquid, a gas is evacuated from the interior volume of the flexible container at 12. For example, the flexible container can define a first port configured to receive a flow of the bulk liquid and a second port configured through which the gas can be evacuated. In some embodiments, the gas can be oxygen and/or any suitable inert gas. In embodiments in which the bulk liquid is, for example, heavy oil, the gas can be a volatile gas produced by the bulk liquid (e.g., $C_5$ hydrocarbon and/or any other volatile gas). In some embodiments, the evacuating of the gas can include injecting an inert gas into the interior volume of the flexible container. In such embodiments, the gas evacuated from the interior volume can include at least a portion of the inert gas. For example, when a heavy oil is disposed in the flexible container, the evacuated gas can include a volatile gas produced by the heavy oil and at least a portion of the inert gas injected into the flexible container. In some embodiments, the inert gas can be configured to chill and/or cool the bulk liquid contained in the flexible container (e.g., a heated heavy oil), as described in detail above.

After the gas is evacuated from the interior volume of the flexible container, the flexible container is disposed in a rigid shipping container configured to receive a dry cargo at 13. In some embodiments, the flexible container can be disposed in the rigid shipping container directly after the gas is evacuated from the interior volume (e.g., substantially without being stored from a period of time). In other embodiments, the flexible container can be placed in a storage or collapsed configuration prior to being disposed in the rigid shipping container. For example, the evacuating of the gas from the interior volume can transition the flexible container from an expanded configuration to the collapsed configuration. In some embodiments, the evacuation of the gas can be in response to and/or can be contemporaneous with an external force exerted on the flexible container by a forming device or the like. In such embodiments, the forming device can be configured to exert a substantially uniform pressure on at least one side of the flexible container to transition the flexible container to the collapsed configuration. Moreover, as described above, the use of the forming device can be place the flexible container in the collapsed configuration in such a manner that allows a set of flexible containers to be stored in a stacked configuration. As such, the flexible containers (stacked or unstacked) can be stored in any suitable place and/or manner after being placed in the collapsed configuration and prior to being disposed in the rigid shipping container.

As described above, in some embodiments, the flexible container can include one or more buffer ribs and/or inflatable bladders that are disposed on one or more outer surface of the flexible container. In such embodiments, the one or more buffer ribs and/or inflatable bladders can be configured to occupy a space otherwise present between the flexible container and one or more side walls of the rigid shipping container. In some embodiments, the buffer ribs and/or inflatable bladders can limit an amount of movement of the flexible container within the rigid shipping container. Moreover, as described in detail above, the arrangement of the container portions and the restriction portions can substantially limit load shifting and/or wave generation of the bulk liquid contained in the flexible container. In embodiments in which the bulk liquid is very dense such as, for example, when the bulk liquid is heavy oil, the buffer ribs and/or inflatable bladders can be inflated to increase a buoyancy of the flexible container when the heavy oil or similarly dense bulk liquid is contained therein.

With the flexible container disposed in the rigid shipping container, the bulk liquid can be shipped via conventional dry cargo means such as dry box van, non-tanker trailers, and/or non-tanker train cars. Moreover, when the bulk liquid is heavy oil, disposing the heavy oil in the flexible container and shipping the flexible container in a rigid shipping container (or not inside a rigid shipping container) can reduce a hazard risk resulting from the decreased temperature of the heavy oil and the decreased volatility. Furthermore, in some instances, when the flexible container is in a collapsed configuration, as described above, the flexible container can form a substantially rigid shape, which in turn, can increase an ease and/or efficiency of storage, handling, transporting, and/or unloading, as described in detail above.

While various embodiments have been described above, it should be understood that they have been presented by way of example only, and not limitation. Where schematics and/or embodiments described above indicate certain components arranged in certain orientations or positions, the arrangement of components may be modified. While the embodiments have been particularly shown and described, it will be understood that various changes in form and details may be made. For example, any of the restriction portions and/or the like described herein can include, for example, an adjustment mechanism and/or device configured to adjust a position, configuration, alignment, arrangement, etc. of the restriction portion. As an example, the flexible container 1000 described above with reference to FIG. 14 can include one or more adjustment mechanisms operably coupled to the bands 1046. In such embodiments, the adjustment mechanisms can be manipulated to increase or decrease an amount of flow restriction (e.g., as a result of the bands 1046) between the container portions 1020. Similarly, any of the flexible containers described herein can include adjustment mechanisms operable to adjust an amount of flow between container portions.

Although various embodiments have been described as having particular features and/or combinations of components, other embodiments are possible having a combination of any features and/or components from any of embodiments as discussed above. For example, while the flexible containers are described herein as including one or more ports that can be configured as a valve or other form of selective access, any of the flexible containers can include a port configured as a relatively large opening as described above with reference to the port 140 of the flexible container 100. Such flexible containers can also include and/or can be coupled to any suitable cover configured to be at least temporarily fixed to the flexible container to obstruct the opening (e.g., after a bulk liquid such as heavy oil or bitumen) has been loaded therein.

Where methods and/or events described above indicate certain events and/or procedures occurring in certain order, the ordering of certain events and/or procedures may be modified. Additionally, certain events and/or procedures may be performed concurrently in a parallel process when possible, as well as performed sequentially as described above.

What is claimed:

1. A system, comprising:

a rigid container configured to receive a dry cargo; and a flexible container defining an interior volume configured to receive a heated bulk liquid, the heated bulk liquid having high viscosity and high volatility, the flexible container configured to be disposed within the rigid container when the flexible container contains the heated bulk liquid, the flexible container including:

a plurality of container portions and a plurality of restriction portions, each container portion from the plurality of container portions having a first cross-sectional area, each restriction portion from the plurality of restriction portions defining a second cross-sectional area less than the first cross-sectional area, each restriction portion from the plurality of restriction portions being disposed between a pair of adjacent container portions and configured to restrict a flow of the heated bulk liquid therebetween, the restricting of the flow of the heated bulk liquid between the container portions configured to limit load shifting of the heated bulk liquid in the flexible container when the flexible container is disposed in the rigid container, a first port configured to allow a volume of the heated bulk liquid to be conveyed into the interior volume of the flexible container, a second port configured to allow (1) a volume of volatile gas released by the heated bulk liquid to be evacuated from the interior volume of the flexible container and (2) a volume of a cooling material to be conveyed into the interior volume of the flexible container, and an inflatable bladder disposed in the interior volume of the flexible container, the inflatable bladder configured to receive the cooling material to cool the heated bulk liquid disposed in the flexible container and to increase a buoyancy of the flexible container when the heated bulk liquid is disposed in the interior volume.

2. The system of claim 1, wherein each container portion from the plurality of container portions has a first volume, each restriction portion from the plurality of restriction portions at least partially defines a second volume less than the first volume.

3. The system of claim 1, wherein the cooling material includes an inert gas configured to cool the heated bulk liquid via the inflatable bladder.

4. The system of claim 1, wherein the flexible container is configured to transition between an expanded configuration and a collapsed configuration, the volume of volatile gas configured to be evacuated from the interior volume of the flexible container when a volume of the heated bulk liquid is contained in the flexible container to transition the flexible container to the collapsed configuration.

5. The system of claim 1, wherein the flexible container is configured to transition between an expanded configuration and a collapsed configuration when a volume of the heated bulk liquid is contained in the flexible container, the system further comprising:

a forming device configured to exert a uniform pressure on at least one side of the flexible container, the volume of volatile gas contained in the interior volume configured to be evacuated to a volume outside of the flexible container while the forming device exerts the uniform pressure to transition the flexible container from the expanded configuration to the collapsed configuration.

6. The system of claim 5, wherein the heated bulk liquid is a heavy oil, the flexible container having a substantially rigid form when in the collapsed configuration such that a flow of the heavy oil within the interior volume is limited.

7. A system, comprising:

a flexible container defining an interior volume configured to receive a volume of a heated bulk liquid, the heated bulk liquid having high viscosity and high volatility;

a cooling element disposed at least partially inside the flexible container, the cooling element including an inflatable bladder in thermal contact with the interior volume of the flexible container and in physical contact with the heated bulk liquid to transfer thermal energy away from the heated bulk liquid; and a forming device configured to exert a uniform pressure on at least one side of the flexible container, a volatile gas released by the heated bulk liquid and contained in the interior volume configured to be evacuated to a volume outside of the flexible container while the forming device exerts the uniform pressure to transition the flexible container from an expanded configuration to a collapsed configuration, the flexible container having a substantially rigid form when in the collapsed configuration such that a flow of the heated bulk liquid within the interior volume is limited, the inflatable bladder configured to receive a cooling material to cool the heated bulk liquid and to increase a buoyancy of the flexible container when the heated bulk liquid is disposed in the interior volume.

8. The system of claim 7, wherein the flexible container includes a first container portion, a second container portion, and a restriction portion disposed between the first container portion and the second container portion, the restriction portion configured to restrict a flow of the heated bulk liquid between the first container portion and the second container portion.

9. The system of claim 7, wherein the flexible container includes a first port and a second port, a volume of the heated bulk liquid configured to be conveyed into the interior volume of the flexible container via the first port, the inflatable bladder configured to receive the cooling material via the second port.

10. The system of claim 7, wherein the cooling element includes a cooling rod.

11. The system of claim 7, wherein the cooling element is configured to cool the heated bulk liquid as the forming device transitions the flexible container to the collapsed configuration.

12. The system of claim 11, wherein the cooling element is configured to remove a sufficient amount of thermal energy from the heated bulk liquid to cool a core portion of the heated bulk liquid to a temperature below a temperature threshold, the flexible container configured to substantially prevent a flow of the heated bulk liquid when the flexible container is in the collapsed configuration and the temperature of the core portion of the heated bulk liquid is below the temperature threshold.

13. The system of claim 7, wherein the forming device includes at least one movable member, the movable member configured to be moved into contact with the at least one side of the flexible container to exert the uniform pressure.

14. The system of claim 7, wherein the cooling element is a first cooling element, the forming device includes a second cooling element such that the forming device removes thermal energy from the heated bulk liquid as the forming device exerts the uniform pressure to transition the flexible container to the collapsed configuration.

15. The system of claim 7, wherein the inflatable bladder is a first inflatable bladder, the flexible container including a second inflatable bladder coupled to an outer surface of the flexible container.

16. A method for packaging bulk liquids, the method comprising:

conveying a heated bulk liquid into an interior volume of a flexible container, the heated bulk liquid having high viscosity and high volatility, the flexible container having a plurality of container portions and a plurality of restriction portions, each restriction portion from the plurality of restriction portions being disposed between a pair of adjacent container portions from the plurality of container portions and configured to restrict a flow of the heated bulk liquid therebetween;

evacuating a volatile gas released by the heated bulk liquid from the interior volume of the flexible container;

conveying a cooling material into an inflatable bladder disposed within the interior volume of the flexible container such that the inflatable bladder cools the heated bulk liquid and increases a buoyancy of the flexible container when the heated bulk liquid is disposed in the interior volume of the flexible container; and disposing the flexible container in a rigid shipping container configured to receive a dry cargo, the restricting of the flow of the heated bulk liquid between the container portions configured to limit load shifting of the heated bulk liquid in the flexible container when the flexible container is disposed in the rigid container.

17. The method of claim 16, wherein the evacuating the volatile gas from the interior volume includes evacuating oxygen from the interior volume such that a storage temperature threshold associated with the heated bulk liquid is increased.

18. The method of claim 16, wherein the heated bulk liquid is a heated heavy oil, the method further comprising:

disposing a cooling element in the interior volume of the flexible container to cool the heated heavy oil disposed within the interior volume of the flexible container prior to the disposing the flexible container in the rigid shipping container.

19. The method of claim 16, further comprising:

exerting a uniform force on at least one exterior surface of the flexible container via a forming device after the conveying the heated bulk liquid into the interior volume to transition the flexible container from an expanded configuration to a collapsed configuration.

* * * * *